US009544676B2

(12) United States Patent
Martin et al.

(10) Patent No.: US 9,544,676 B2
(45) **Date of Patent: *Jan. 10, 2017**

(54) OVAL SHAPED IN-EAR HEADPHONE

(71) Applicant: Klipsch Group, Inc., Indianapolis, IN (US)

(72) Inventors: Anthony Martin, Indianapolis, IN (US); Thomas Edward Gospel, Carmel, IN (US); Brooke Lyn Hilsmeyer, Indianapolis, IN (US); Andrew Joshua Doerr, Indianapolis, IN (US)

(73) Assignee: Klipsch Group, Inc., Indianapolis, IN (US)

( * ) Notice: Subject to any disclaimer, the term of this patent is extended or adjusted under 35 U.S.C. 154(b) by 33 days.

This patent is subject to a terminal disclaimer.

(21) Appl. No.: 14/248,773

(22) Filed: Apr. 9, 2014

(65) Prior Publication Data

US 2015/0256921 A1 Sep. 10, 2015

Related U.S. Application Data

(63) Continuation-in-part of application No. 14/202,004, filed on Mar. 10, 2014.

(51) Int. Cl.

| | |
|---|---|
| ***H04R 25/00*** | (2006.01) |
| ***H04R 1/10*** | (2006.01) |
| *H04R 1/28* | (2006.01) |

(52) U.S. Cl.

CPC ..... *H04R 1/1066* (2013.01); *H04R 1/1016* (2013.01); *H04R 1/2811* (2013.01)

(58) Field of Classification Search

CPC ..... H04R 1/1016; H04R 25/48; A61F 11/12; A61F 2011/085

(Continued)

(56) References Cited

U.S. PATENT DOCUMENTS 6,683,965 B1 * 1/2004 Sapiejewski ..... H04R 1/1083 381/370

7,916,888 B2 3/2011 Sapiejewski et al.

(Continued)

FOREIGN PATENT DOCUMENTS

WO WO 2009/239447 A1 1/2012

OTHER PUBLICATIONS

International Search Report & Written Opinion of the International Searching Authority, PCT/US15/19555—Related PCT Application of this pending application.

*Primary Examiner* — Curtis Kuntz
*Assistant Examiner* — Julie X Dang
(74) *Attorney, Agent, or Firm* — Indiano & McConnell LLC

(57) ABSTRACT

A pair of in-ear headphones is disclosed that are operable to reproduce incoming audio signals. The in-ear headphones include an oval shaped housing defining an internal chamber. A front portion of the oval shaped housing defines a nozzle extending away from the housing. A driver is positioned in the internal chamber such that a sound reproduction portion of the driver is aligned with an internal audio channel running through the nozzle. A damper is positioned in an end of the nozzle having a damper aperture having a predetermined size. The nozzle extends from a base portion of the housing at a predetermined upward angle and a predetermined bend angle that provides improved audio frequency responses in desirable frequency ranges.

40 Claims, 30 Drawing Sheets

(58) Field of Classification Search
USPC ..... 381/74, 330, 380, 381
See application file for complete search history.

(56) References Cited

U.S. PATENT DOCUMENTS

| | | | | |
|---|---|---|---|---|
| D641,008 | S | 7/2011 | Lee et al. | |
| D646,262 | S | 10/2011 | Chiu | |
| 8,107,665 | B2 | 1/2012 | Haapapuro et al. | |
| 8,238,596 | B2 | 8/2012 | Blanchard et al. | |
| D674,373 | S | 1/2013 | Combs et al. | |
| 8,391,535 | B1 | 3/2013 | Harvey et al. | |
| 8,594,351 | B2 | 11/2013 | Harlow et al. | |
| 8,666,085 | B2 | 3/2014 | Donaldson et al. | |
| 2008/0002835 | A1* | 1/2008 | Sapiejewski ..... | H04R 1/1016 381/71.6 |
| 2009/0147981 | A1* | 6/2009 | Blanchard ..... | H04R 1/1075 381/380 |
| 2009/0285436 | A1* | 11/2009 | Lowry ..... | H04R 1/1016 381/380 |
| 2011/0103637 | A1* | 5/2011 | Yuen ..... | H04R 1/1041 381/380 |

* cited by examiner

OVAL SHAPED IN-EAR HEADPHONE

CROSS-REFERENCE TO RELATED APPLICATION

The present application is a continuation-in-part of and claims the benefit of and priority to U.S. application Ser. No. 14/202,004 filed Mar. 10, 2014 and entitled "IN-EAR HEADPHONE."

INTRODUCTION

Headphones are generally understood to be a pair of small loudspeakers that are designed to be placed next to a user's ears so that a user can listen to audio transmissions. Alternative versions of headphones that are worn in-ear are often referred to as earbuds or earphones. Earbuds either have wires for connection to a signal source or have a wireless device that is configured to receive signals from a signal source. Earbuds are very small headphones that fit directly into the outer ear. Earbuds typically face the ear canal but are not directly inserted into the ear canal. They provide little acoustic isolation and allow ambient noise to be heard by a user. In-ear headphones are small headphones that are inserted directly into the ear canal of the user. Because in-ear headphones engage the ear canal, they are less prone to falling out and block out much of the ambient noise that surrounds a user thereby providing higher quality sound reproduction.

BRIEF DESCRIPTION OF THE DRAWINGS

FIGS. 19*a-b* illustrates a front and side view of the rear housing of the headphone.

DETAILED DESCRIPTION

Figure 1:
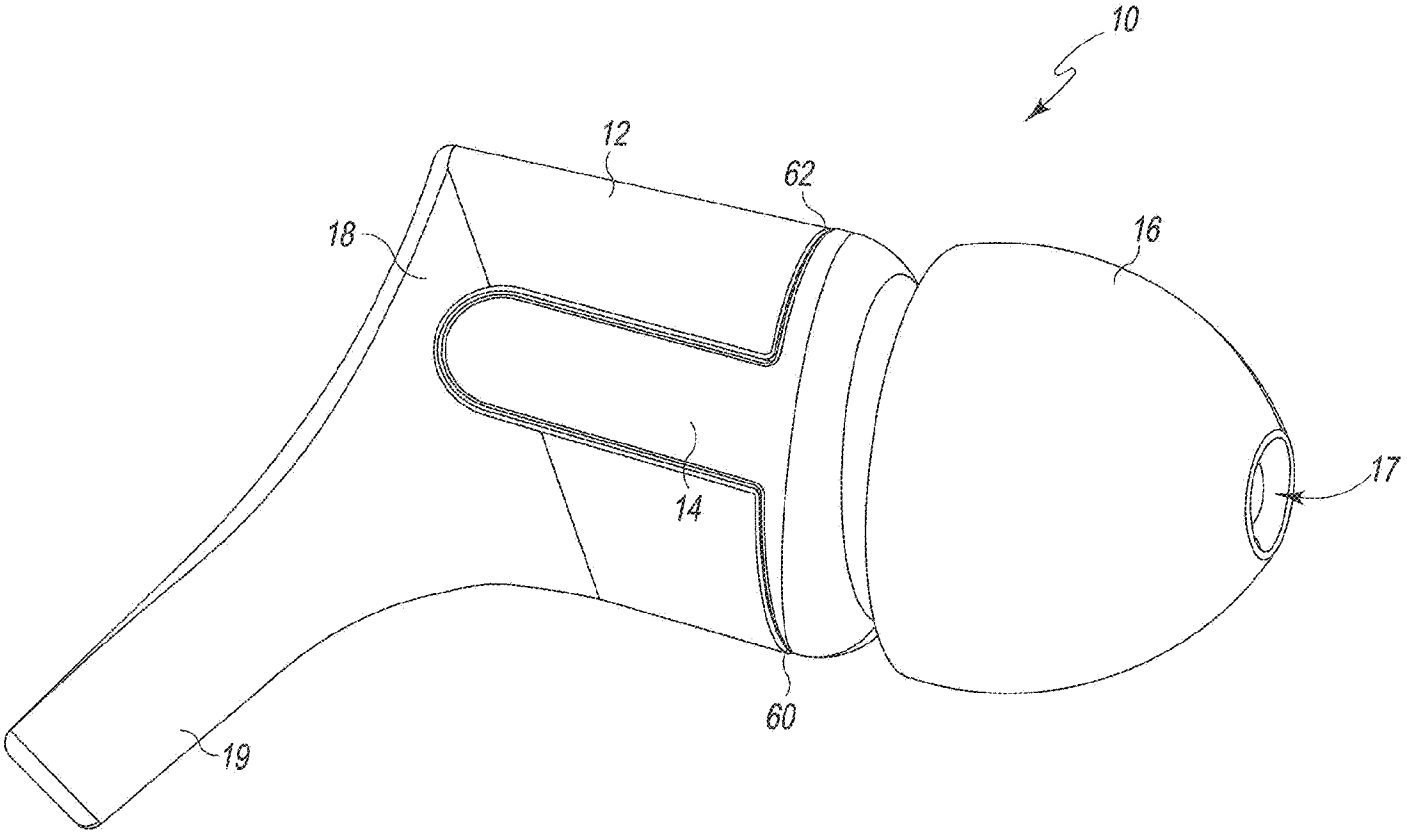
FIG. 1 illustrates a representative in-ear headphone.
Figure 2:
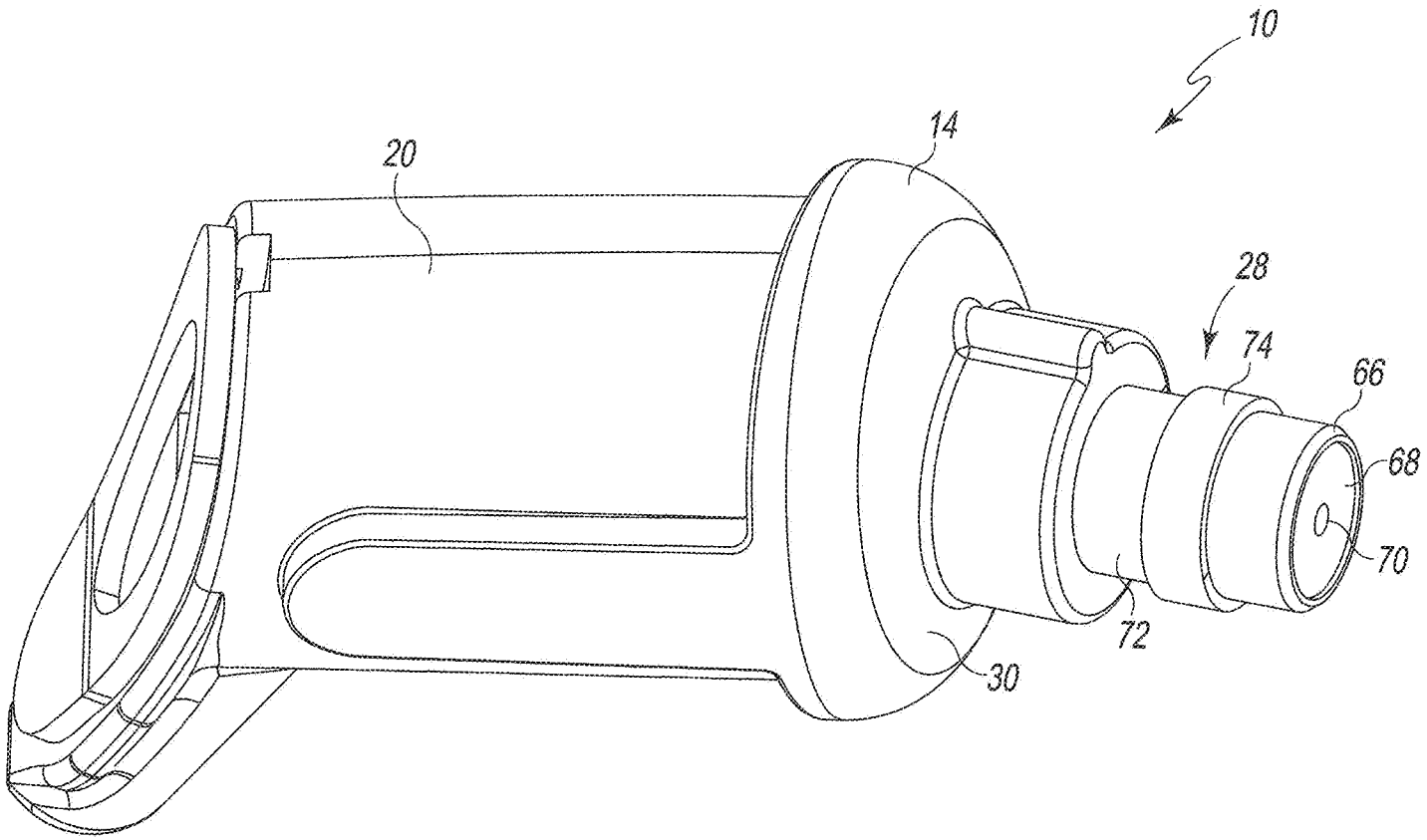
FIG. 2 illustrates a view of the in-ear headphone depicted in FIG. 1 with an outer housing and eartip removed.

Referring to FIG. 1, an in-ear headphone 10 is illustrated that includes a co-molded rear housing 12, a front housing 14, and an eartip 16. The co-molded rear housing 12 and front housing 14 have an oval shape along a vertical axis through the housings 12, 14. In the illustrated form, the eartip 16 comprises an oval-shaped eartip 16 having an aperture 17 in and end thereof so that sound waves can travel out of the in-ear headphone 10 and into the ear canal of a user. In one form, the co-molded rear housing 12 is connected with the front housing 14 using a friction fit. The co-molded rear housing 12 could also be connected with the front housing 14 using an adhesive. Referring collectively to FIGS. 1 and 2, the co-molded rear housing 12 comprises an outer housing 18 and an inner housing 20. In FIG. 2, the outer housing 18 has been removed from the inner housing 20. In one form, the outer housing 18 is connected with the inner housing 20 using a friction fit. The outer housing 18 could also be connected with the inner housing 20 using an adhesive. In the illustrated form, the outer housing 18 includes a downwardly extending extension 19 located at the rear of the outer housing 18 that is configured to receive an electrical conductor or wire.

Figure 3:
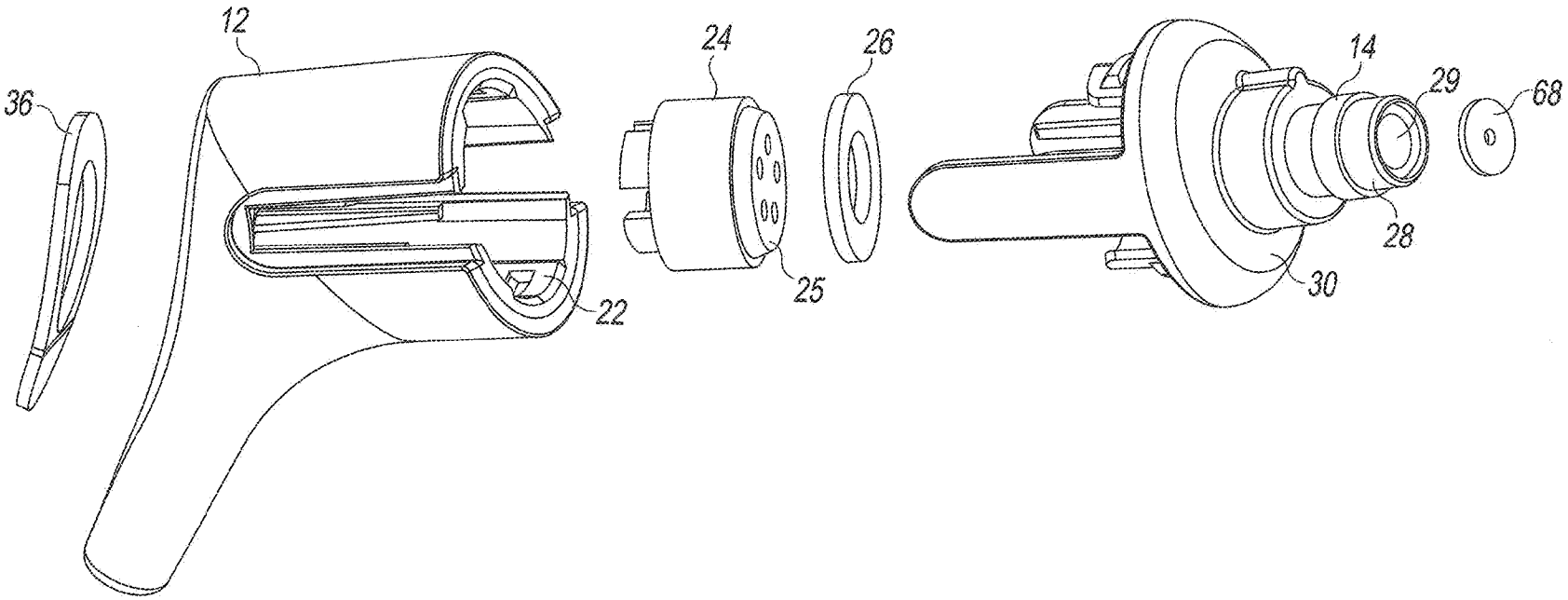
FIG. 3 illustrates a component view of the in-ear headphone depicted in FIG. 1.
Figure 4:
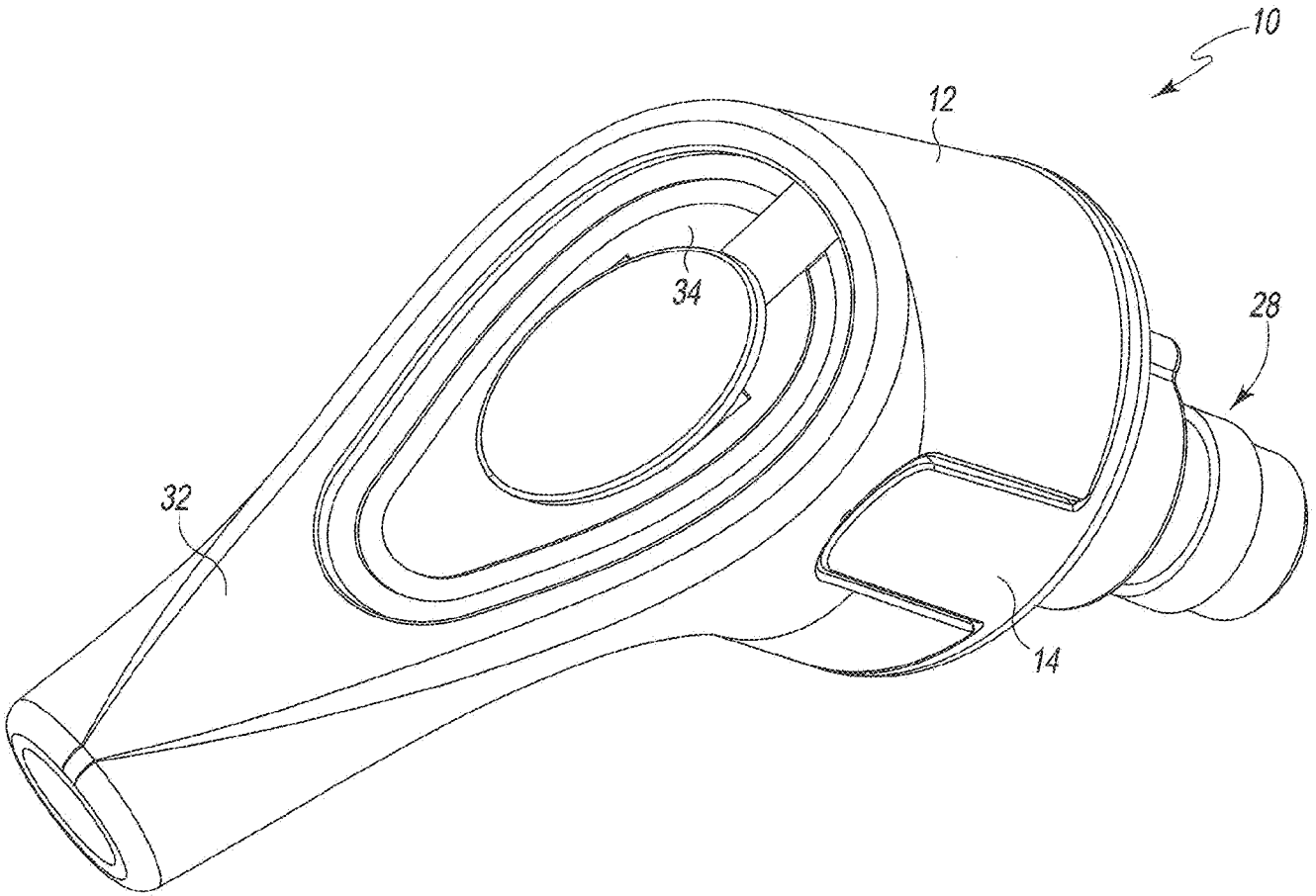
FIG. 4 illustrates a rear view of the in-ear headphone depicted in FIG. 1.

Referring to FIG. 3, an exploded component view of the in-ear headphone 10 is depicted. As illustrated, the in-ear headphone 10 includes the co-molded rear housing 12 and the front housing 14. Housed within an interior chamber 22 defined by the co-molded rear housing 12 and front housing 14 is a driver 24 and a driver gasket 26. The driver 24 is used to reproduce sound and in one form, comprises a 6.5 mm moving-coil driver. The front housing 14 includes a nozzle 28 that extends outwardly from a base portion 30 of the front housing 14. When assembled, a sound reproduction portion 25 of the driver 24 is aligned with an internal audio channel 29 defined by the nozzle 28. During operation, the sound reproduction portion 25 of the driver 24 directs sound waves through the internal audio channel 29 where the sound waves then pass through a damper 68 and out of the in-ear headphones 10 to the ear canal of a user. Referring collectively to FIGS. 3 and 4, a back portion 32 of the outer rear housing 18 includes a recession 34. A decorative plate 36 fits within the recession 34 in the back portion 32 of the outer rear housing 18.

Figure 5:
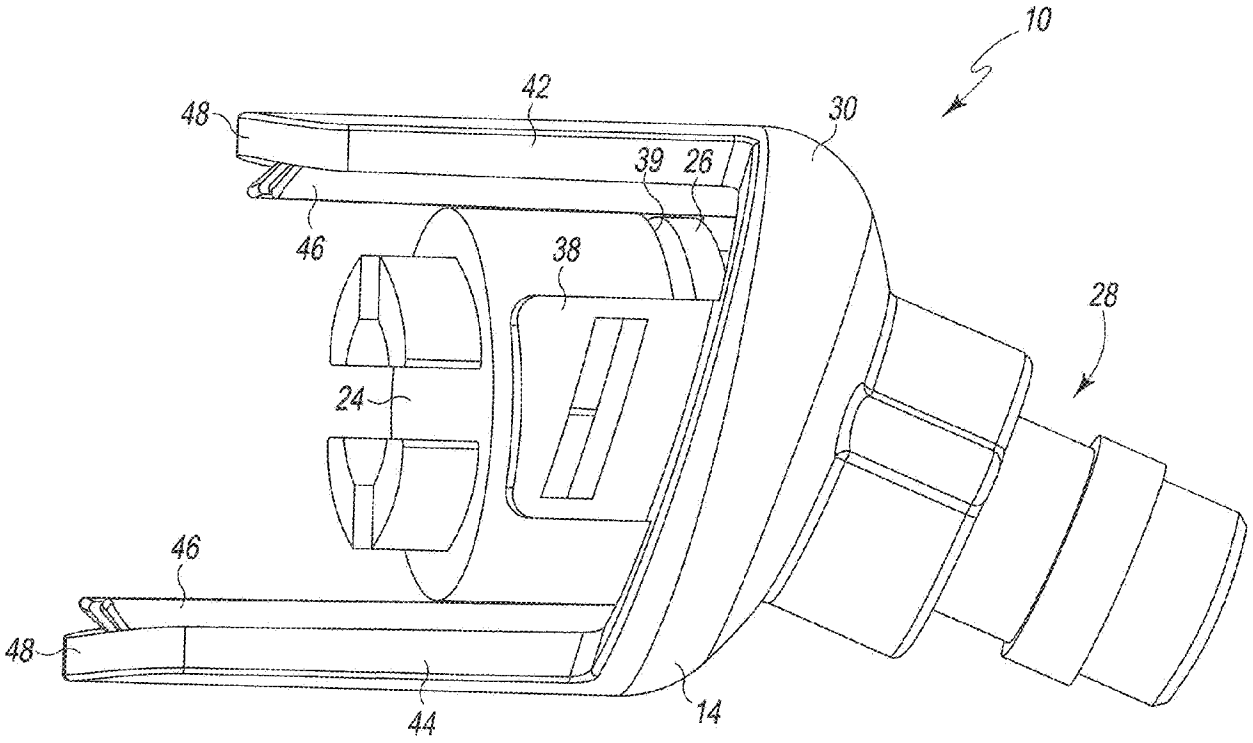
FIG. 5 illustrates a top view of a front housing and driver of the in-ear headphone depicted in FIG. 1.
Figure 6:
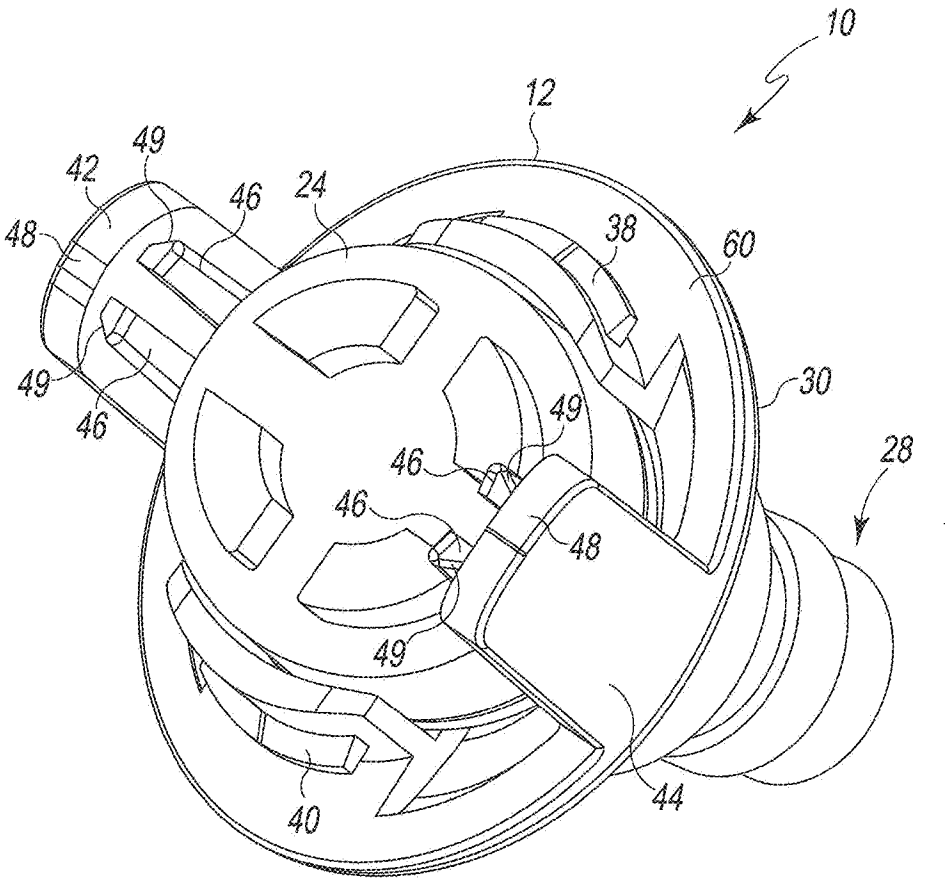
FIG. 6 illustrates a rear view of the front housing and driver depicted in FIG. 5.
Figure 7:
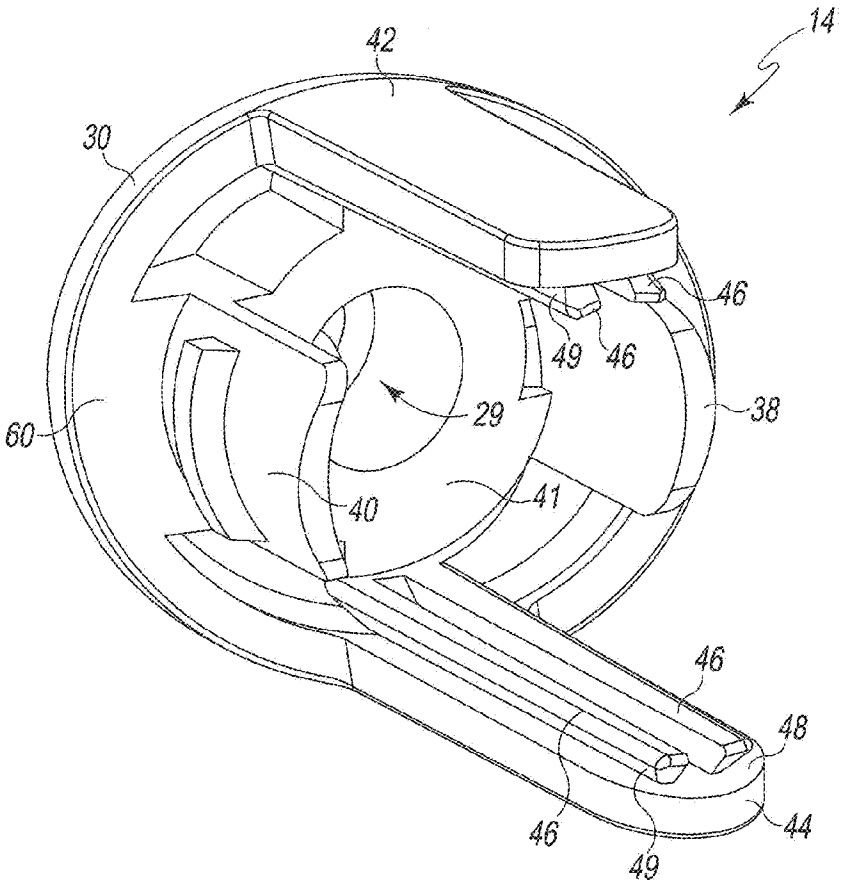
FIG. 7 illustrates another rear view of the front housing depicted in FIG. 5 with the driver removed.

Referring collectively to FIGS. 5 and 6, the front housing 14 is depicted with the driver 24 secured thereto. As illustrated, the base portion 30 of the front housing 14 includes a first driver support bracket 38 and a second driver support bracket 40. As illustrated, the first and second driver support brackets 38, 40 extend outwardly from the base portion 30. The base portion 30 has a generally cylindrical shape and the driver support brackets 38, 40 also have a generally cylindrical shape. In the illustrated form, the driver support brackets 38, 40 are oriented on opposite sides from one another on the base portion 30. The driver 24 also has a generally cylindrical shape and is friction fit and connected with the driver support brackets 38, 40 thereby securing the driver 24 in place in the front housing 14. As illustrated, the driver 24 is positioned between the driver support brackets 38, 40. As illustrated in FIGS. 5 and 7, the driver gasket 26 is positioned between a front surface 39 of the driver 24 and an interior surface 41 of the base portion 30 of the front housing 14.

The front housing 12 also includes a first arm 42 and a second arm 44 that extend outwardly from the base portion 30. As illustrated, the first arm 42 is shorter in length than the second arm 44 and the first and second arms 42, 44 are disposed on opposite sides from one another. An interior portion or surface of the first and second arms 42, 44 include one or more rails 46 that extend outwardly from the base portion 30 toward an end 48 of the first and second arms 42, 44. The rails 46 include inwardly tapering portions 49 to help secure the front housing 14 to the rear housing 12.

Figure 8:
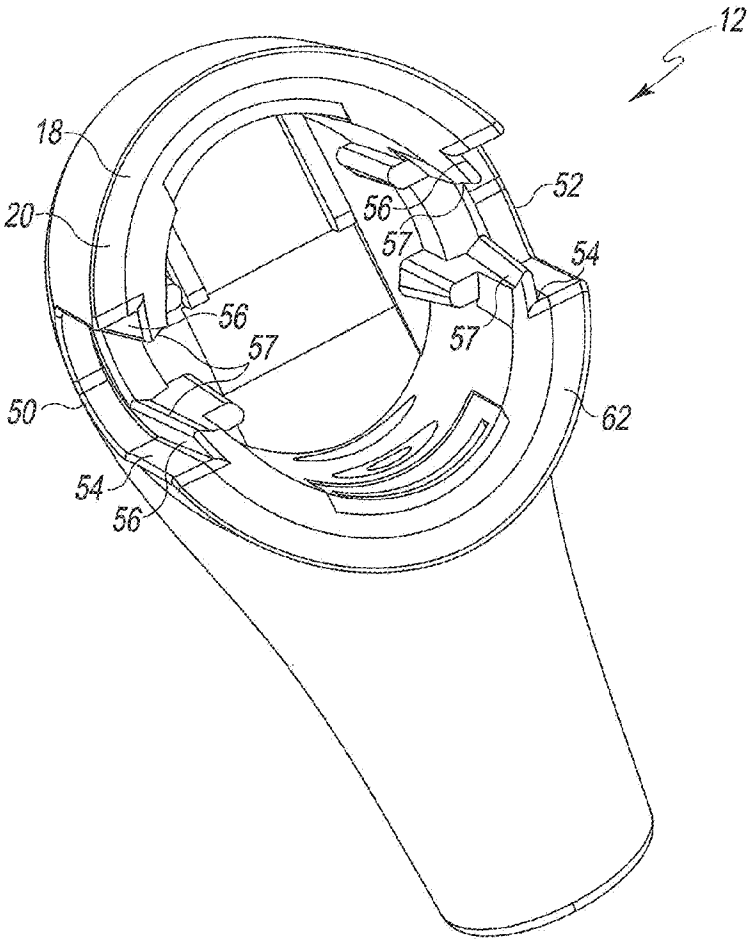
FIG. 8 illustrates a front perspective view of the rear housing of the in-ear headphone depicted in FIG. 1.
Figure 9:
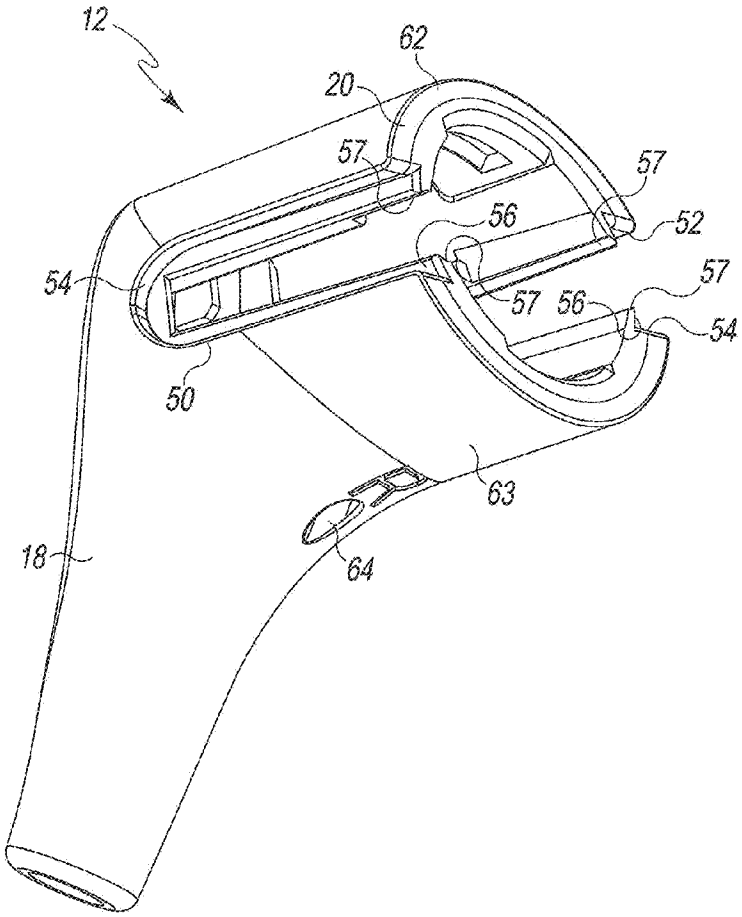
FIG. 9 illustrates a side perspective view of the rear housing of the in-ear headphone depicted in FIG. 1.

Referring to FIGS. 8 and 9, the outer housing 18 includes a first U-shaped slot 50 and a second U-shaped slot 52 that oppose one another. The inner housing 20 includes a pair of opposing U-shaped recessed slots 54 that define a pair of L-shaped interior walls 56. The interior walls 56 in each recessed slot 54 extend toward one another thereby defining a track in each respective U-shaped recessed slot 54. Each interior wall 56 includes an inwardly tapering portion 57 on one leg of the L-shaped interior walls 56 that is sized and configured to accept the inwardly tapering portions 49 of the rails 46 located on the opposing arms 42, 44 of the front housing 14. As such, the inwardly tapering portions 49 of the rails 46 of the arms 42, 44 are secured within the inwardly tapering portions 57 of the U-shaped recessed slots 54 to secure the first housing 12 to the second housing 14. Thus, a locking mechanism is thereby created in which the arms 42, 44 slide into the U-shaped slots 50, 52 of the outer housing 18 and the rails 46 lock or secure the front housing 14 in place in the rear housing 12 by using the tapered portions 49 of the rails 46 to mate with the tapered portions 57 of the interior walls 56 defined by the U-shaped recessed slots 54.

Referring collectively to FIGS. 1 and 5-9, when assembled the first and second arms 42, 44 are inserted into the U-shaped slots 50, 52 defined by the outer housing 18 of the rear housing 12. The rails 46 of the first and second arms 42, 44 fit between the interior wall 56 defined by the inner housing 20 of the rear housing 12. As depicted in FIG. 1, an interior surface 60 of the base portion 30 defined by the front housing 14 is placed against an outer end surface 62 defined by the rear housing 12.

Referring to FIG. 9, an underneath portion 63 of the rear housing 12 includes an aperture or vent 64 that extends into the interior chamber 22 defined by the rear housing 12. In this form, the vent 64 extends through both the outer housing 18 and inner housing 20. The vent 64 allows ambient air to enter the interior chamber 22. The vent 64 allows the in-ear headphone 10 to have enhanced bass frequency responses during operation thereby improving the quality of sound reproduced by the in-ear headphone 10. In one form, the vent 64 has a diameter of about 1.0 millimeter. In other forms, the vent 64 could have a diameter in the range of about 0.5 millimeters to 2.0 millimeters.

Referring back to FIG. 2, the front housing 14 includes a base portion 30 that includes a nozzle 28 extending outwardly from the base portion 30. Positioned within an end or end portion 66 of the nozzle 28 is a damper 68. As will be discussed in greater detail below, the damper 68 includes an aperture or hole 70 having a predefined diameter. In one form, the hole 70 has a diameter of about 0.6 millimeters and the damper 68 is made from polyethylene terephthalate ("PET"). In other forms, the hole 70 has a diameter in the range of about 0.4-0.8 millimeters. A central portion 72 of the nozzle 28 has a band 74 having a larger diameter than the rest of the nozzle 28 that helps secure the eartip 16 to the nozzle 28.

Figure 10:
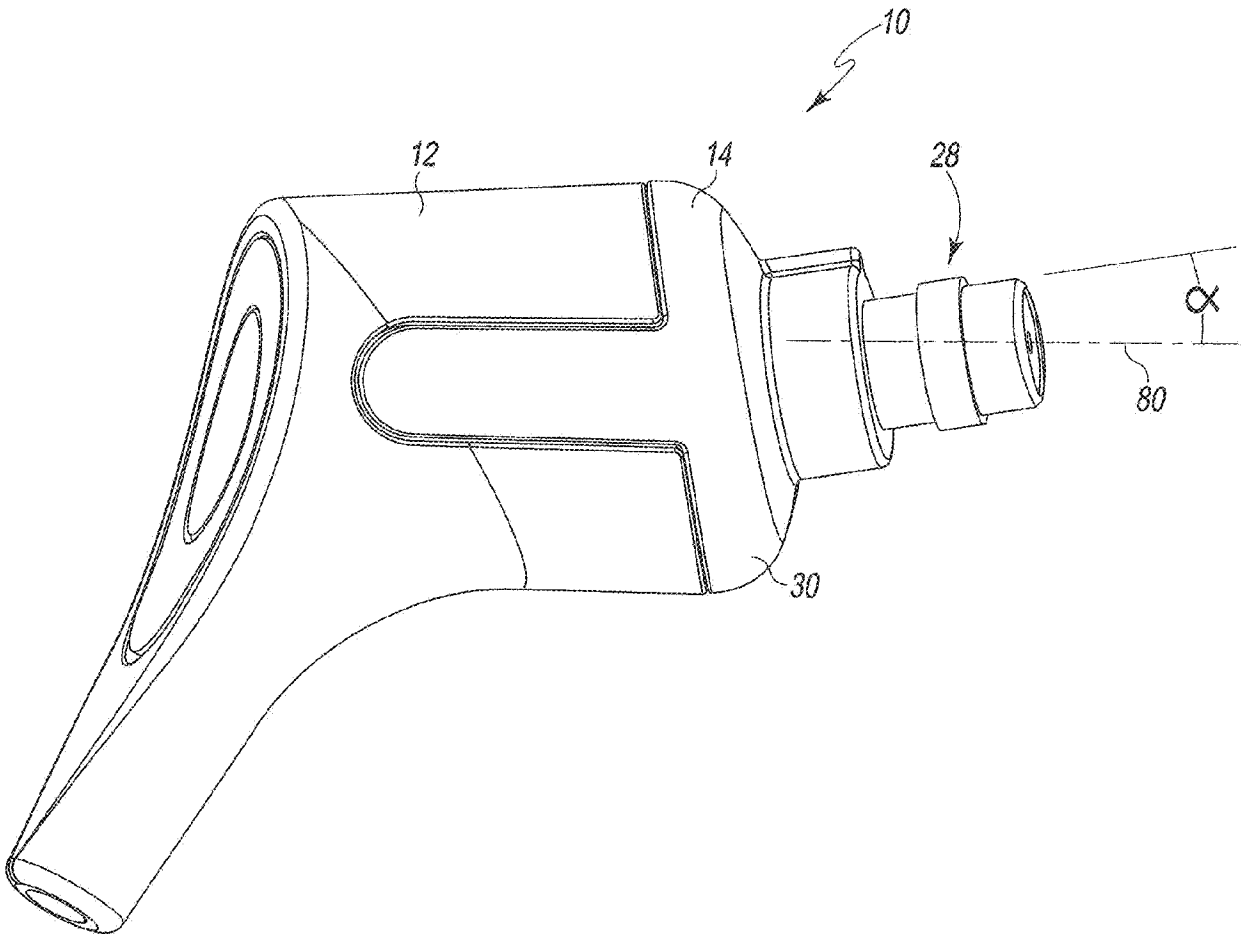
FIG. 10 illustrates a side view of the in-ear headphone.
Figure 11:
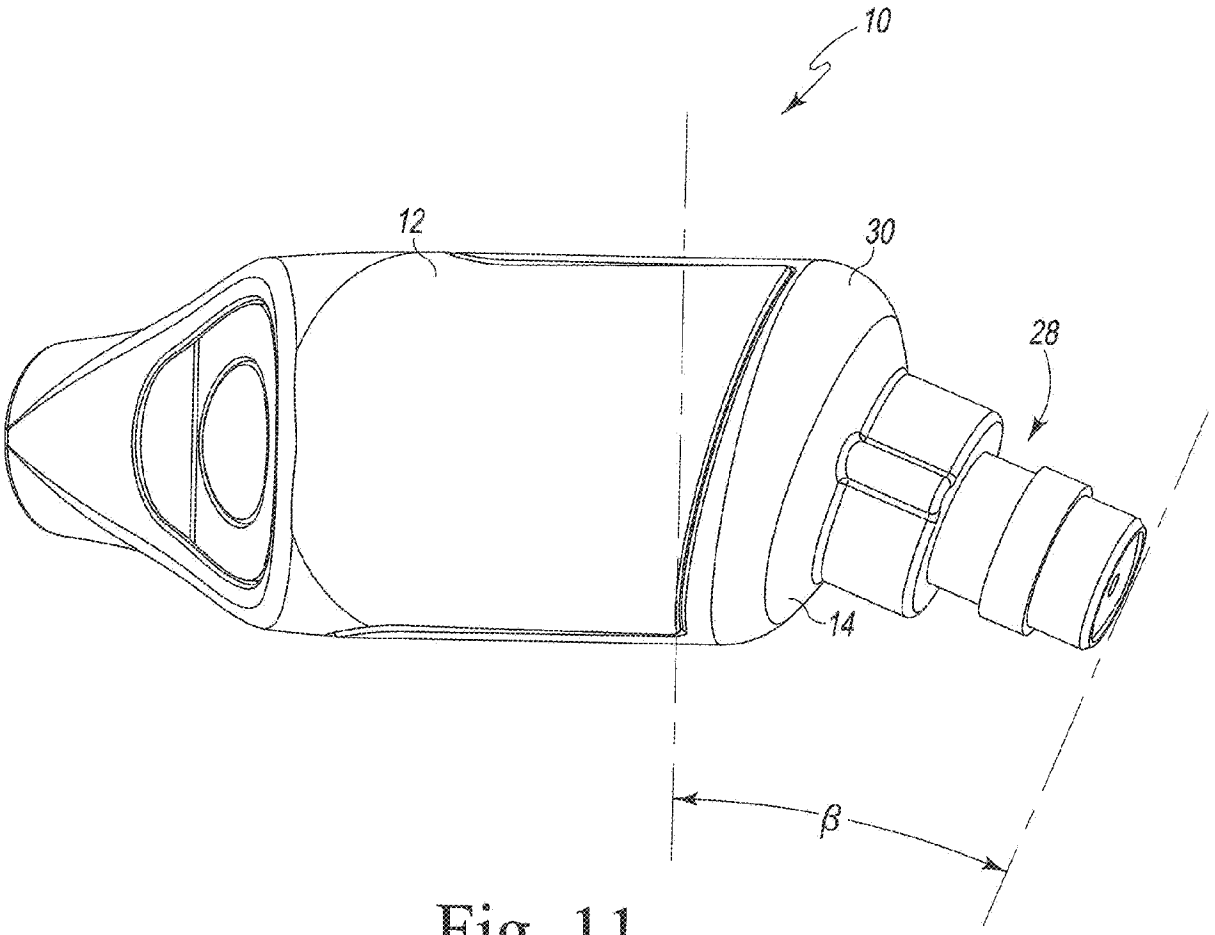
FIG. 11 illustrates a top view of a right in-ear headphone.

Referring to FIG. 10, a front side view of the in-ear headphone 10 is illustrated with the eartip 16 removed. As depicted, the nozzle 28 is oriented in relation to a horizontal axis of the rear housing 12 and a portion of the base portion 30 of the front housing 14 to have a predetermined upward or vertical angle $\alpha$. In one form, the upward angle $\alpha$ is about 10.0°. In another form, the upward angle $\alpha$ could have a range from about 8-12°. Referring to FIG. 11, a top view of the in-ear headphone 10 is illustrated with the eartip 16 removed. As depicted, the nozzle 28 is oriented in relation to a vertical axis of the rear housing 12 and a portion of the base portion 30 of the front housing 14 to have a predetermined bend angle $\beta$. In one form, the predetermined bend angle $\beta$ is about 22.0°. In another form, the bend angle $\beta$ could have a range from about 15-30°.

Figure 12:
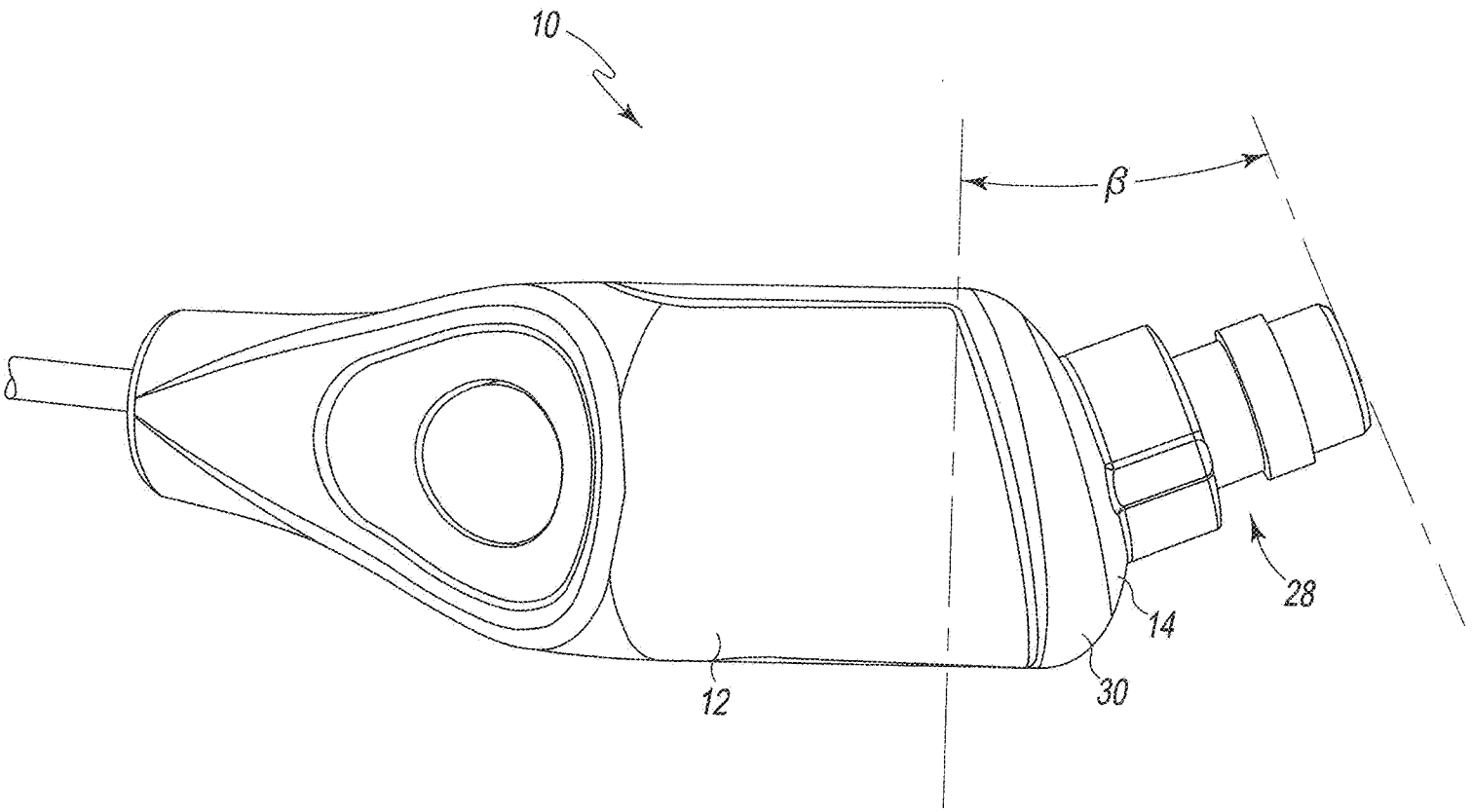
FIG. 12 illustrates a top view of a left in-ear headphone.

The in-ear headphone 10 illustrated in FIG. 11 is the right in-ear headphone 10, and in this instance the predetermined bend angle $\beta$ is a downward bend angle $\beta$. Referring to FIG. 12, the left in-ear headphone 10 is illustrated, and in this instance the predetermined bend angle $\beta$ is an upward bend angle $\beta$. Thus, the in-ear headphones 10 disclosed herein have an upward angle $\alpha$ and a bend angle $\beta$. Originally, the upward and bend angles were included to more conform to the outer and inner ear of a user from a comfort and fit perspective. However, as set forth in detail below, it was discovered that the upward and bend angles also provided unexpected results in improving the acoustic performance of the in-ear headphones 10 disclosed herein.

Figure 13:
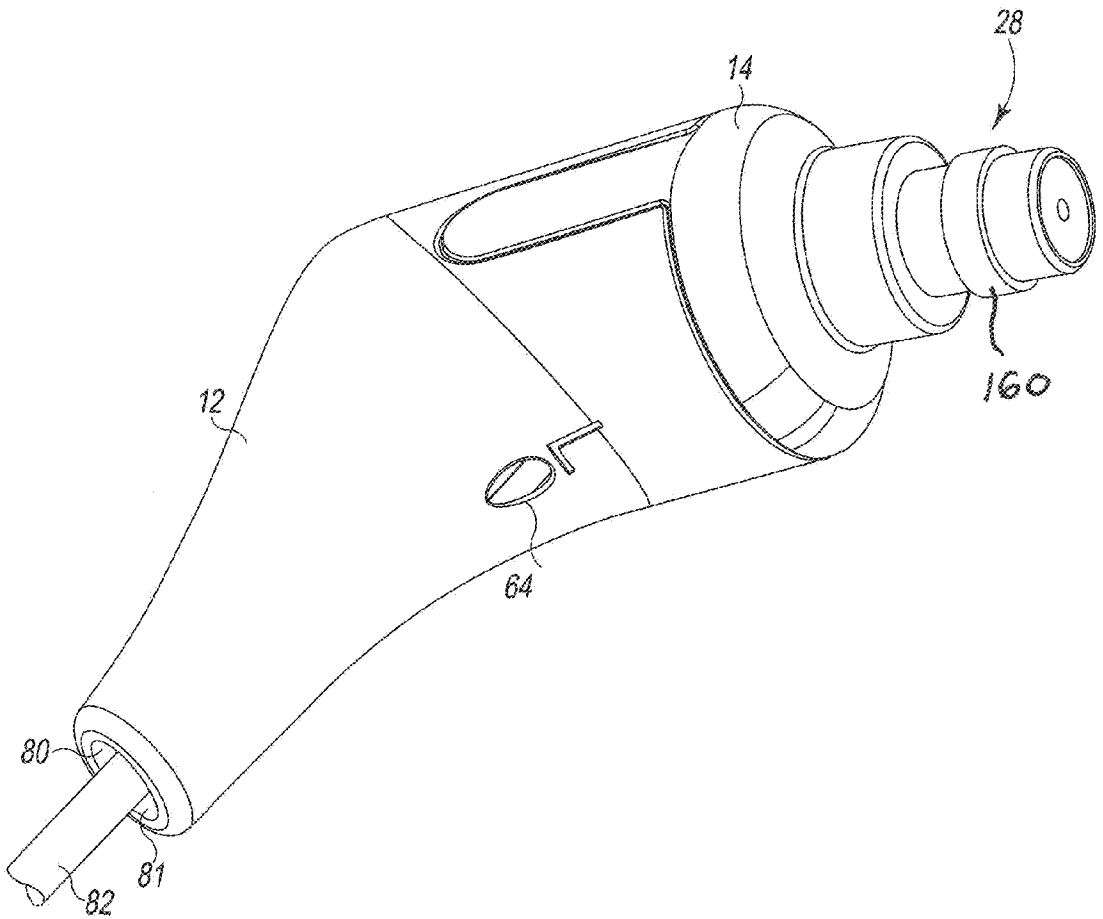
FIG. 13 illustrates a bottom view of the left in-ear headphone.
Figure 14:
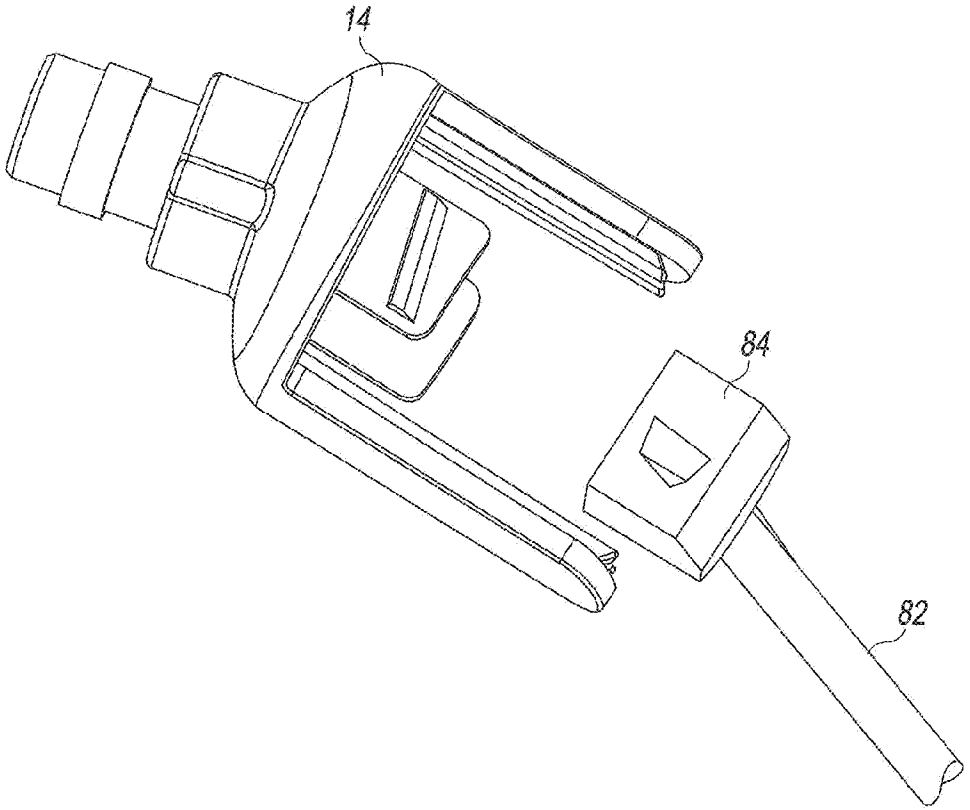
FIG. 14 illustrates a top view of the front housing and respective electrical components of the in-ear headphone.

Referring to FIG. 13, a lower portion 80 of the rear housing 12 includes an aperture 81 sized and configured to receive a conductive wire 82 that is used to transmit electric signals to the driver 24. As illustrated in FIG. 14, the conductive wire 82 runs through the aperture 81 to an electrical connector 84 contained within the interior chamber 22 defined by the rear housing 12. The output of the electrical connector 84 is then connected with the driver 24 thereby providing electric signals to the driver 24 during use of the in-ear headphone 10. The electrical connector 84 also serves to secure the conductive wire 82 within the rear portion of the rear housing 12.

Figure 15:
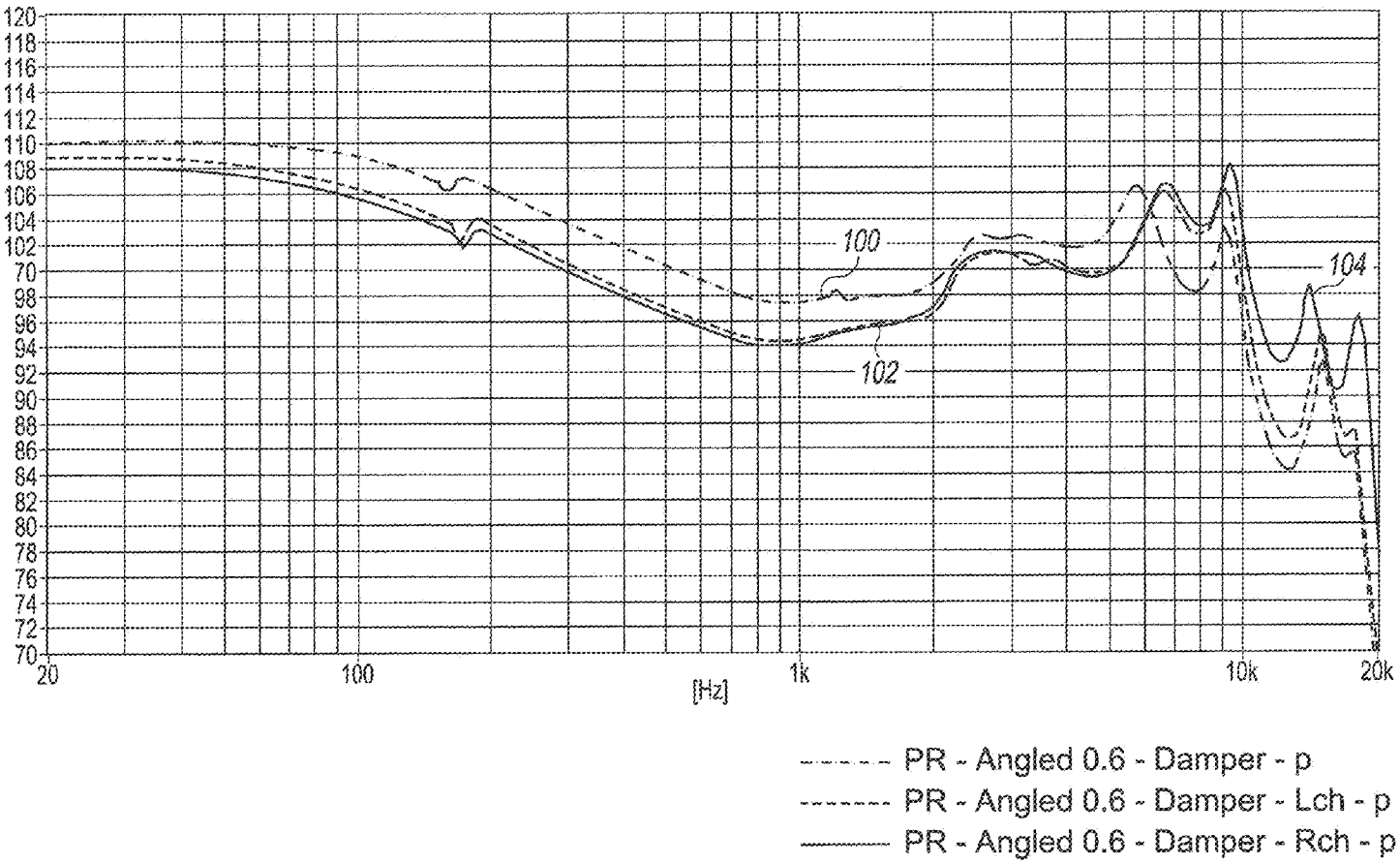
FIG. 15 illustrates a frequency response curve showing frequency responses for an angled in-ear headphone and straight in-ear headphones having a damper with a hole having a diameter of about 0.6 millimeters.

Referring to FIG. 15, a frequency response curve is illustrated having a frequency range of 20 Hz to 20 kHz on the horizontal axis and a sound pressure level reading in decibels (dB) ranging from 70 dB to 120 dB on the vertical axis. The frequency response curve was created by sweeping a constant-amplitude pure tone through the bandwidth range depicted on the horizontal axis and measuring the resulting sound pressure levels generated by the respective in-ear headphones being analyzed. In FIG. 15, the in-ear headphone 10 disclosed and claimed herein was first tested and the resulting output is represented at 100 in FIG. 15. Thus, the in-ear headphone tested in this form had an upward angle α of 10.0°, a bend angle β of 22.0° and a damper having a 0.6 millimeter hole (hereinafter the "angled nozzle"). Next, two separate in-ear headphones were tested that did not include an upward angle α or a bend angle β. The nozzle 28 was a straight nozzle and had a damper with a 0.6 millimeter hole (hereinafter the "straight nozzle"). The test results for the two straight nozzle in-ear headphones are labeled 102, 104 respectively. As illustrated, the straight nozzle version had a considerably weaker response from about 100 Hz to 2 kHz than the angled nozzle version. Further, the straight nozzle version had a much brighter response from about 6 k to 10 k than the angled nozzle version, which is undesirable. As such, the angled nozzle version of the in-ear headphones 10 outperformed the straight nozzle version from an acoustic sound quality standpoint and a comfort and fit standpoint.

Figure 16:
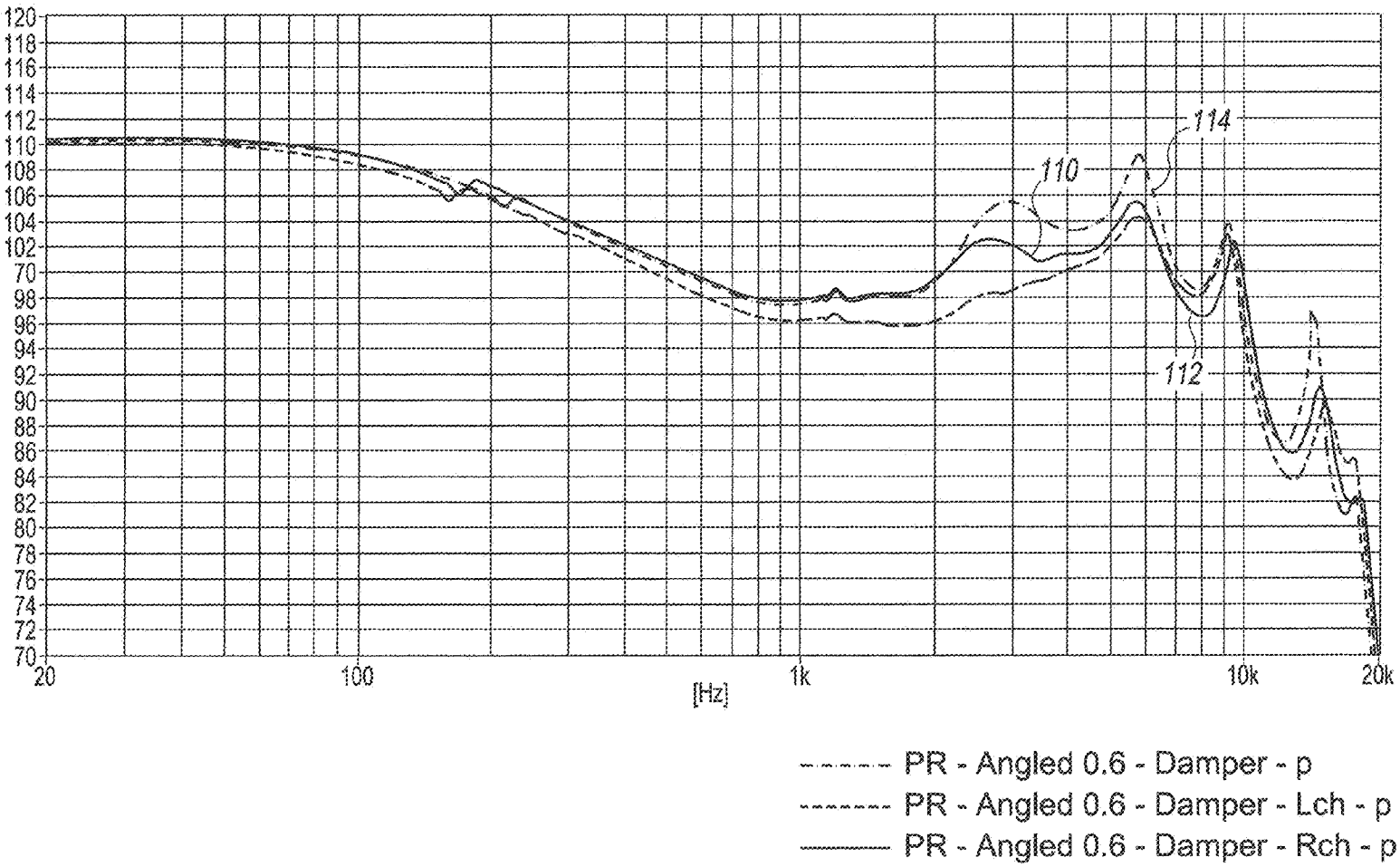
FIG. 16 illustrates a frequency response curve showing frequency responses for an angled in-ear headphone having no damper, a full damper, and a damper having a hole having a diameter of about 0.6 millimeters.

Referring to FIG. 16, another set of tests was conducted in which frequency response curves were generated for the angled nozzle versions of the in-ear headphones 10 having a 0.6 millimeter hole in the damper 68, no hole in the damper 88, and no damper 68. The in-ear headphone 10 having a 0.6 millimeter hole in the damper is illustrated at 110, no hole in the damper 68 is illustrated at 112, and no damper 68 at all is illustrated at 114. As illustrated, the in-ear headphone with no damper was too "bright" (i.e.—very high notes) from about 2.3 kHz to 6 kHz, which is undesirable. The in-ear headphone with the damper 68 having a 0.6 millimeter hole was relatively smooth from about 2.3 kHz to 6 khz, which is desirable. The in-ear headphone with a full damper 68 having no hole was too "muddy" or didn't have enough "presence" from about 1 kHz to 4 kHz, which is also undesirable. As such, once again, the angled version of the in-ear headphones 10 disclosed herein having a damper 68 with a 0.6 millimeter hole outperformed other versions of in-ear headphones.

Figure 17:
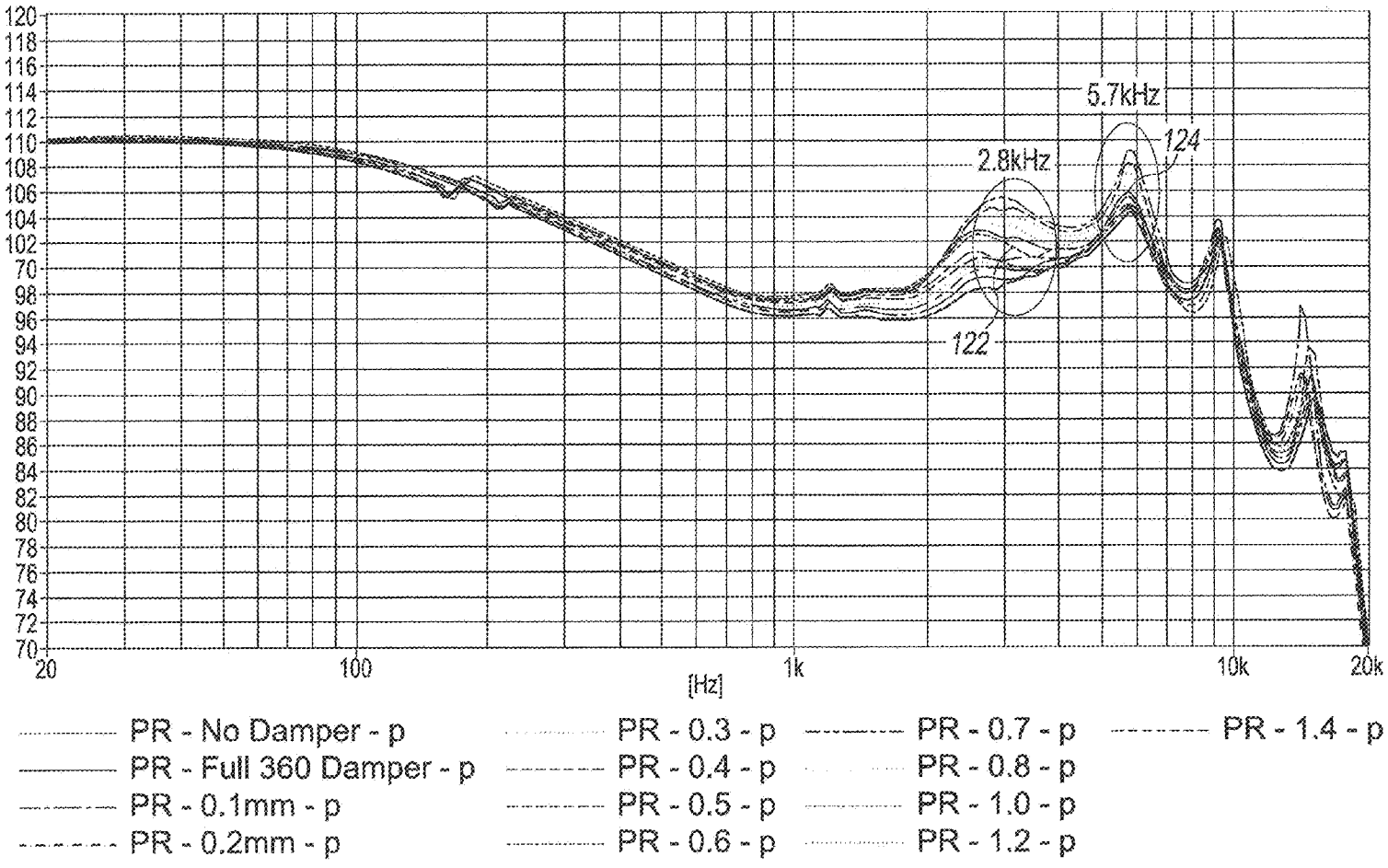
FIG. 17 illustrates a frequency response curve showing frequency responses for an angled in-ear headphone having no damper, a full damper, and dampers having holes ranging from about 0.1 millimeters to 1.4 millimeters.

Referring to FIG. 17, frequency response curves were generated for various other in-ear headphone design variations. These frequency response curves were generated to show the effects of various different damper designs. In particular, frequency response curves were generated for in-ear headphones designed as disclosed herein having no damper 68, a full damper 68 (with no hole), and then in-ear headphones having dampers 68 having holes in the following diameters 0.1 millimeters, 0.2 millimeters, 0.3 millimeters, 0.4 millimeters, 0.5 millimeters, 0.6 millimeters, 0.7 millimeters, 0.8 millimeters, 1.0 millimeters, 1.2 millimeters, and 1.4 millimeters. As illustrated, the in-ear headphone 10 having a damper 28 with a 0.6 millimeter hole outperformed all of these other design variations. This version's frequency response curve is labeled at 122 and 124 in FIG. 17. Other variations were either too high or muddy in the frequency ranges of about 2 kHz to 4 kHz and 5 kHz to 7 kHz. The optimal curve, the one that was most balanced, is represented by the angled nozzle version of the in-ear headphone 10 with a damper 68 having a 0.6 millimeter hole.

Figure 18:
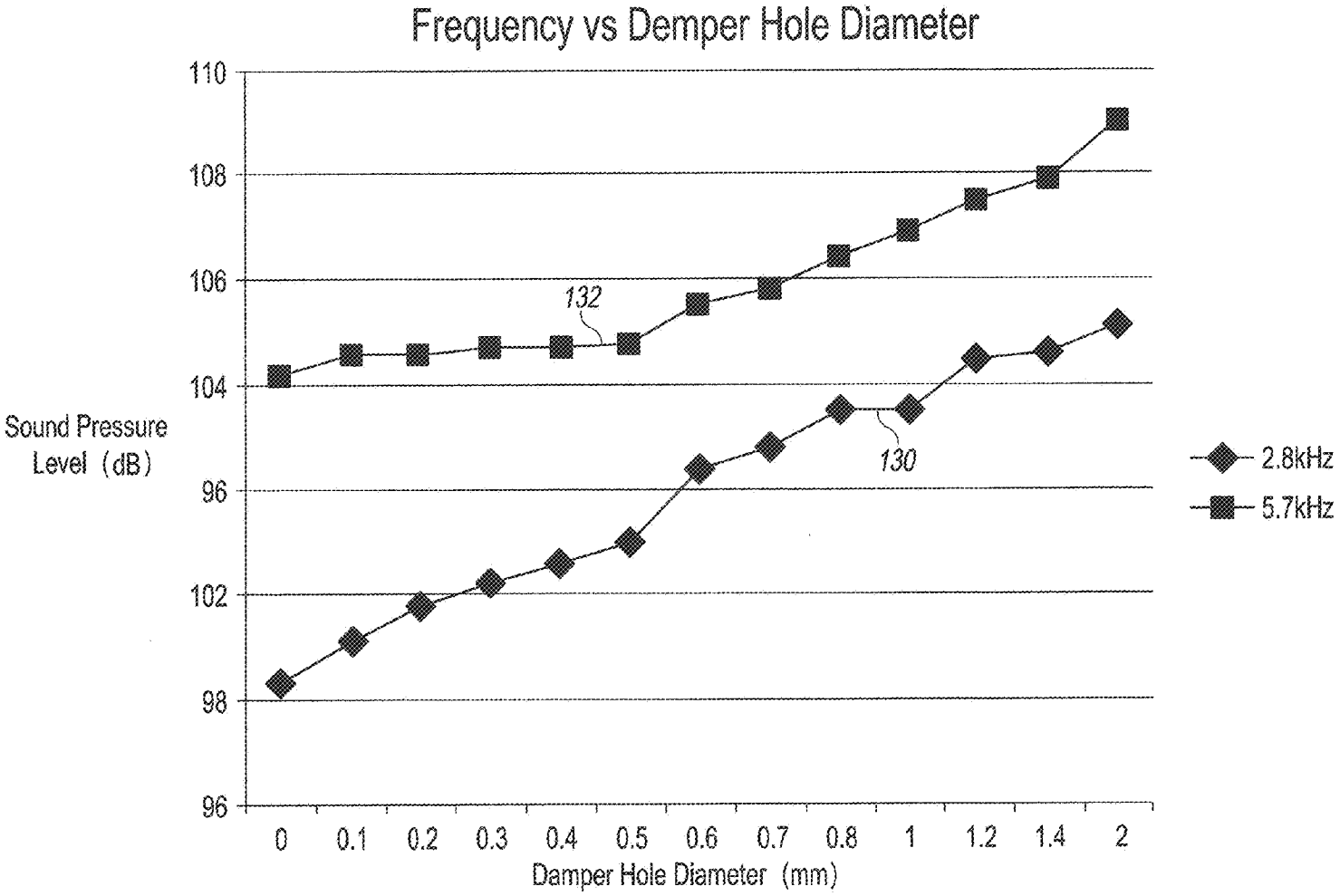
FIG. 18 is a graph showing sound pressure levels for different respective damper hole sizes for two frequencies.
Figure 18A:
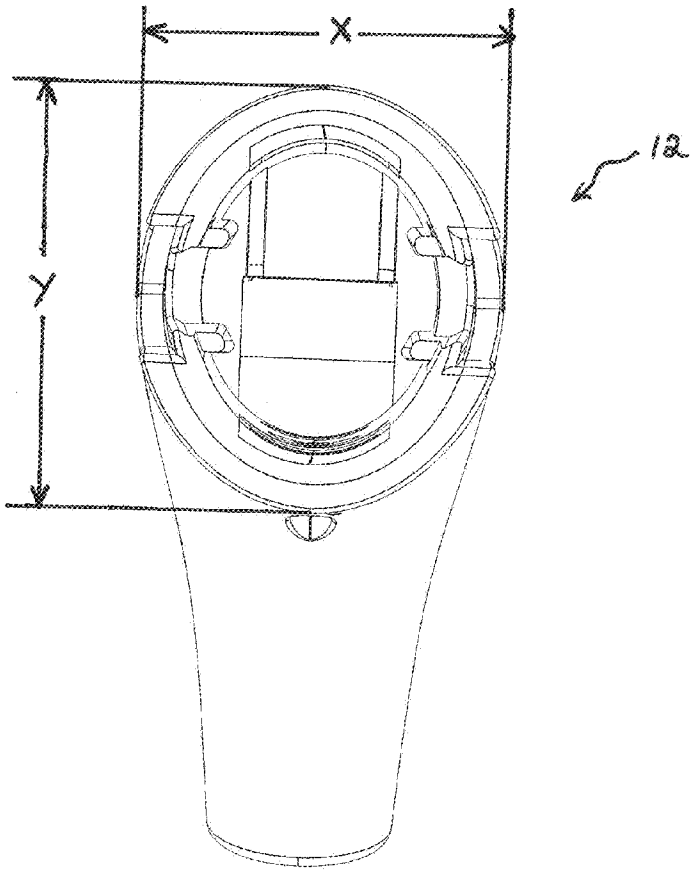

Referring to FIG. 18, a graph is provided that discloses sound pressure level values in the vertical axis compared to damper hole size in the horizontal axis. Frequency responses were charted for a 2.8 kHz signal and a 5.7 kHz signal for various damper hole sizes. The frequency responses for the 2.8 kHz signal is labeled 130 and the frequency response for the 5.7 kHz signal is labeled 132. The table below lists the results:

| Hole Size (mm) | 2.8 kHz Value (dB) | 5.7 kHz Value (dB) |
|---|---|---|
| 0 | 98.3 | 104.2 |
| 0.1 | 99.1 | 104.6 |
| 0.2 | 99.8 | 104.6 |
| 0.3 | 100.2 | 104.7 |
| 0.4 | 100.6 | 104.8 |
| 0.5 | 101 | 104.8 |
| 0.6 | 102.4 | 105.5 |
| 0.7 | 102.8 | 105.8 |
| 0.8 | 103.5 | 106.4 |
| 1.0 | 103.5 | 106.9 |
| 1.2 | 104.5 | 107.5 |
| 1.4 | 104.6 | 107.9 |
| 2.0 | 105.1 | 109 |

As set forth in the chart above and illustrated in FIG. 18, damper hole sizes between 0.6-0.8 millimeters resulted in the most increase of the 2.8 kHz peak and the least increase of the 5.8 kHz peak. As previously set forth, the more balanced the frequency response is across the entire audible human hearing spectrum the higher the quality of sound reproduction the in-ear headphone is capable of providing. It has been found with respect to the in-ear headphone 10 disclosed herein that a damper hole 70 that is sized at about 0.6 millimeters produces the desired results across this audible spectrum.

Figure 19B:
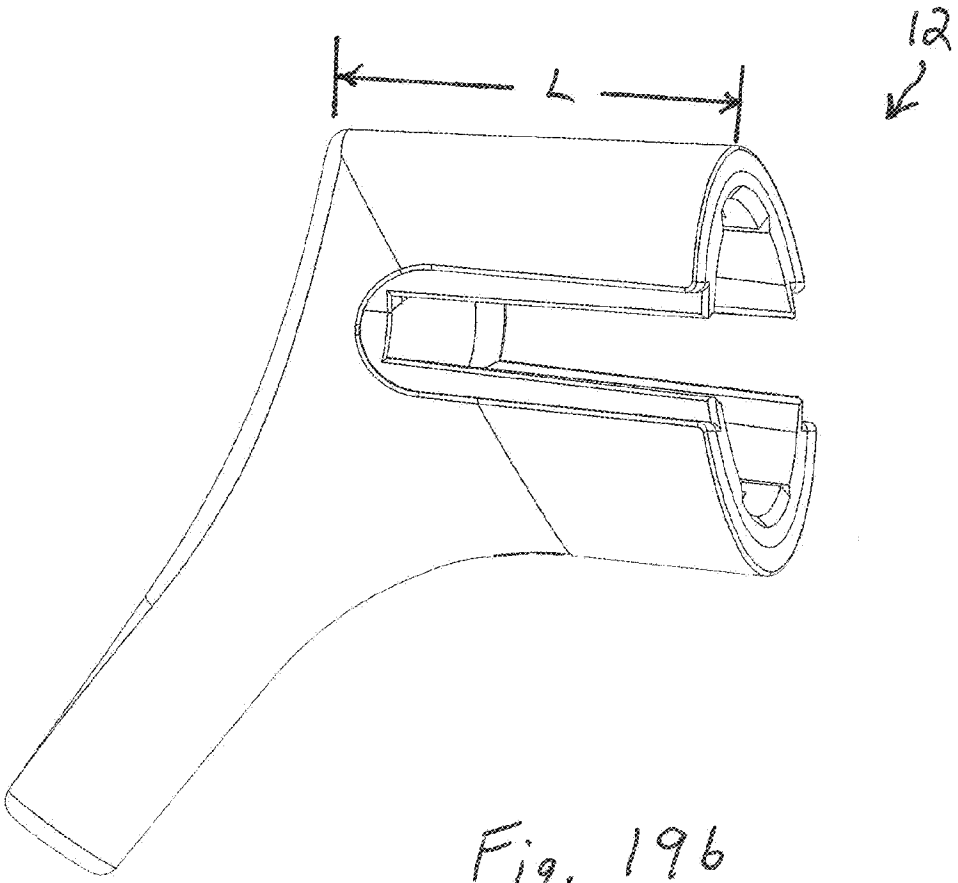

Referring to FIGS. 19*a* and 19*b*, a front and side view of the rear housing 12 is illustrated. The rear housing 12 has an oval shape running across the cross-sectional length L of the rear housing 12. In the preferred form, the rear housing 12 is about 11.277 mm in height along a vertical axis y and about 9.575 mm in width along a horizontal axis x. As such, in this form the rear housing 12 has a width to height ratio of about 1:1.177. In another form, the rear housing 12 is about 8.045 mm in height along the vertical axis y and about 6.715 mm in width along the horizontal axis x. In this form, the rear housing 12 has a width to height ratio of about 1:1.198. In yet another form, the rear housing 12 is about 15.214 mm in height along the vertical axis y and about 13.029 in width along the horizontal axis x. In this form, the rear housing 12 has a width to height ratio of about 1:1.168. As such, the height y of the rear housing 12 can range between about 8.045 mm to 15.214 mm and the width x of the rear housing 12 can range between 6.715 mm to 13.029 mm. The width to height ratio of the rear housing 12 can range between about 1:1.117 to 1:1.198. Regardless of the ranges used, the rear housing 12 will always preferentially be configured to have an oval shape because of the superior performance characteristics achieved by these configurations.

Figure 20:
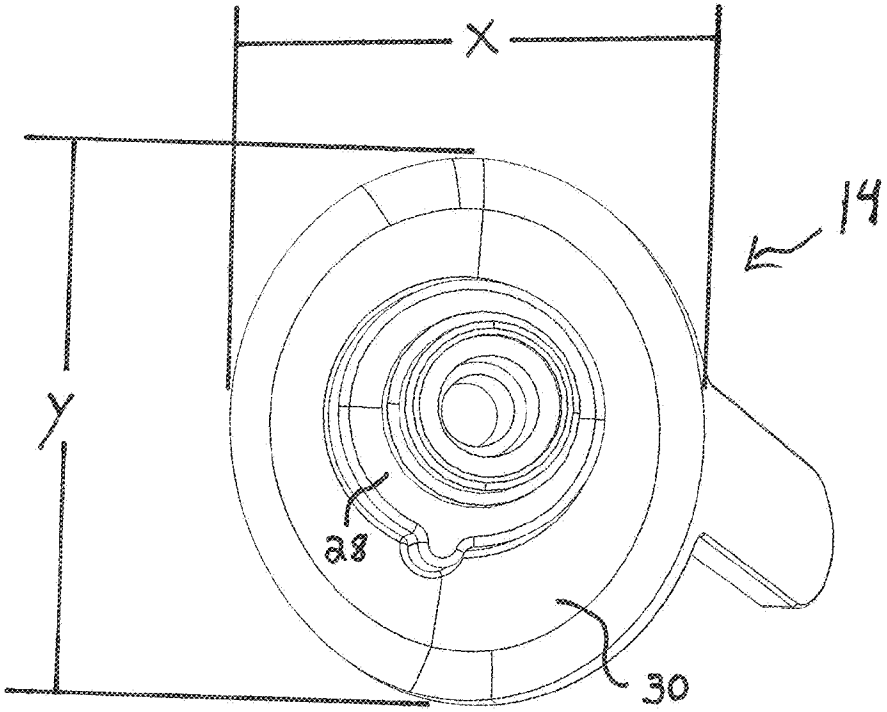
FIG. 20 illustrates a front view of a front housing of the headphone.
Figure 21A:
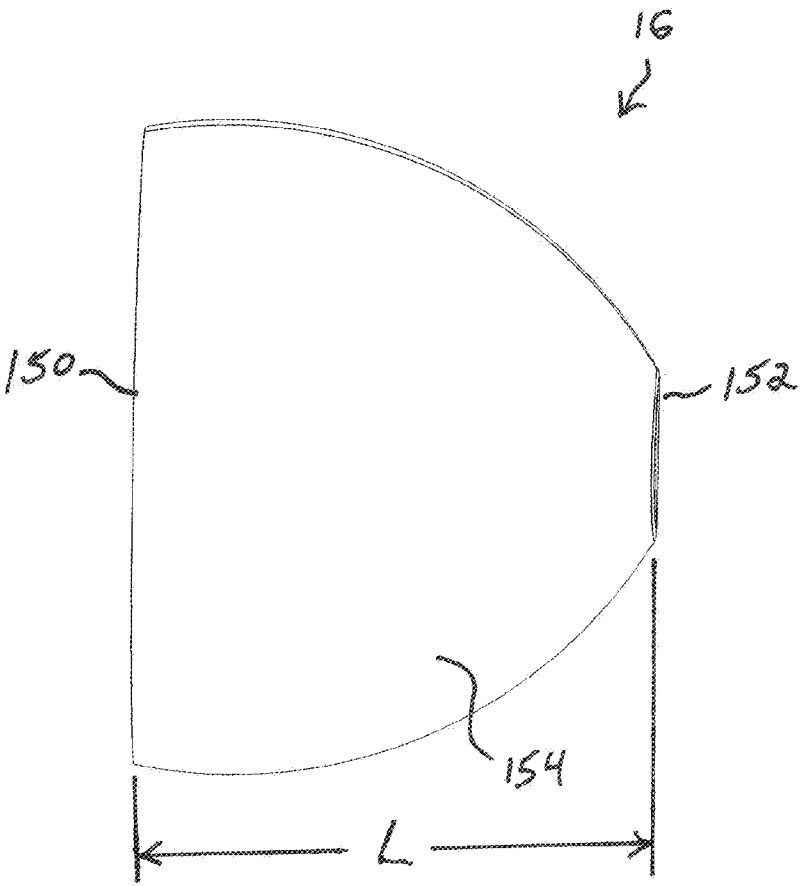
FIGS. 21*a-d* illustrate a representative eartip of the headphone.
Figure 21B:
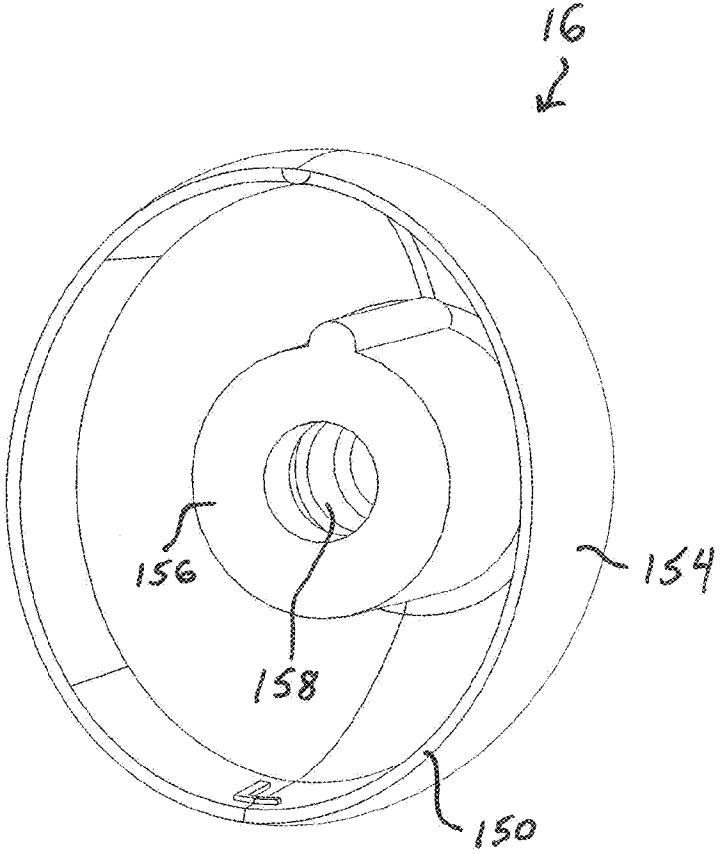
Figure 21C:
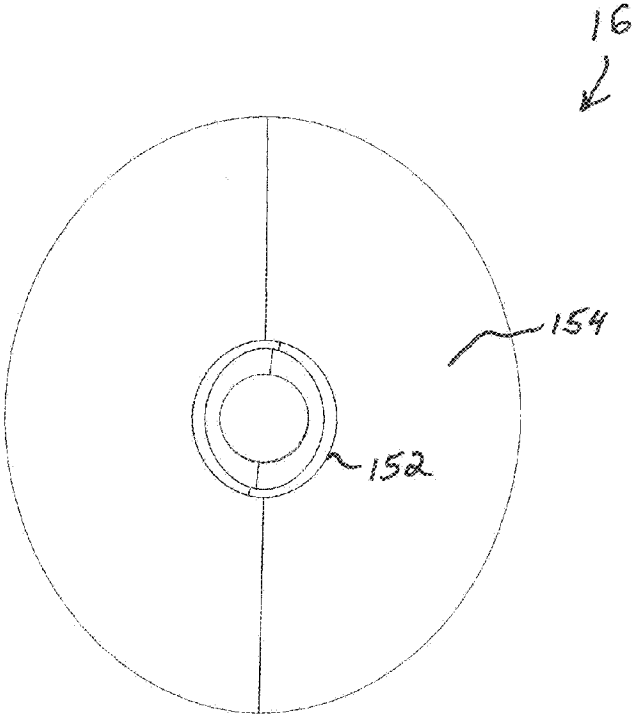
Figure 21D:
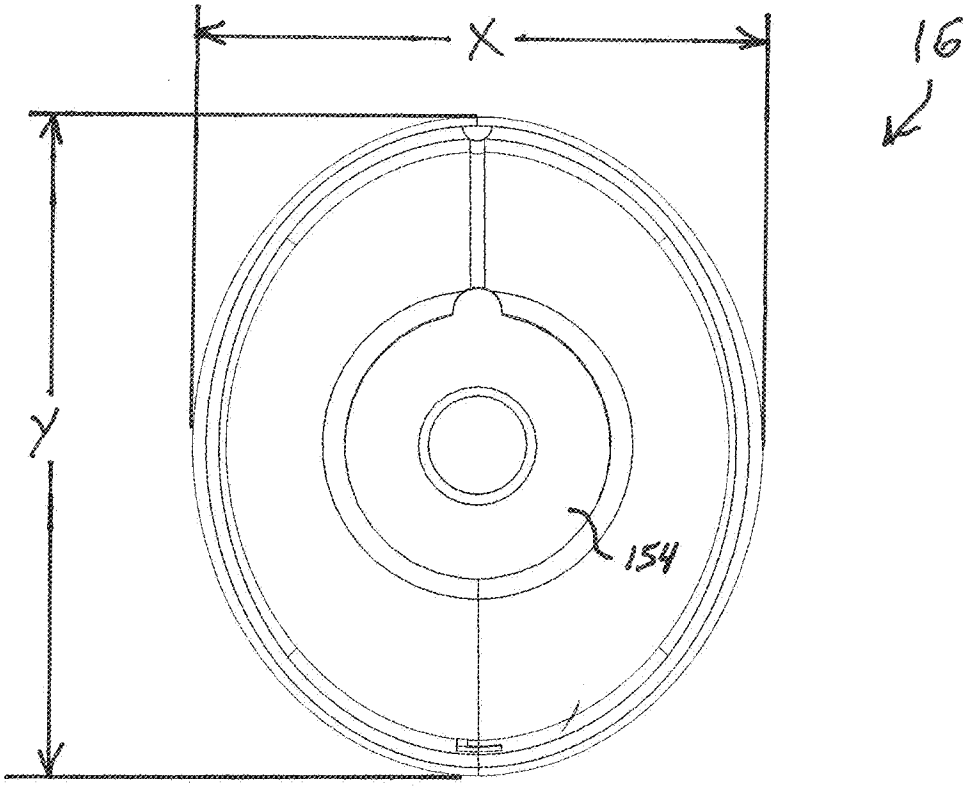

Referring to FIG. 20, a front view of the front housing 14 is illustrated. As previously discussed, in this form the front housing 14 includes a base portion 30 and a nozzle 28 extending away from the base portion 30. The base portion 30 of the front housing 14 has an oval shape that matches the oval shape of the rear housing 12. In the illustrated preferred form, the base portion is about 11.277 mm in height along a vertical axis y and about 9.575 mm in width along a horizontal axis x. As such, in this form the base portion 30 has a width to height ratio of about 1:1.177. In another form, the base portion is about 8.045 mm in height along the vertical axis y and about 6.715 mm in width along the horizontal axis x. In this form, the base portion 30 has a width to height ratio of about 1:1.198. In yet another form, the base portion 30 is about 15.214 mm in height along the vertical axis y and about 13.029 in width along the horizontal axis x. In this form, the base portion 30 has a width to height ratio of about 1:1.168. As such, the height y of the base portion 30 can range between about 8.045 mm to 15.214 mm and the width x of the base portion 30 can range between 6.715 mm to 13.029 mm. Regardless of the ranges used, the base portion 30 of the front housing 14 will always preferentially be configured to have an oval shape to match that of the rear housing 12.

Referring collectively to FIGS. 1 and 21*a-d*, the eartip 16 also preferentially has an oval shape from a lower end 150 of the eartip 16 to an upper end 152 of the eartip 16. The eartip 16 includes a flange 154 that tapers downwardly from the lower end 150 to the upper end 152. As such, the flange 154 becomes narrower as it tapers from the lower end 150 to the upper end 152. An inner body 156 having a cylindrical shape extends from the upper end 152 downwardly toward the lower end 150 of the eartip 16. An interior portion of the inner body 156 includes a circular shaped notch 158. Referring to FIG. 13, the notch 158 of the eartip 16 is sized and configured to receive a cylindrically shaped rib 160 located on the nozzle 28. The rib 160 secures the eartip 16 to the nozzle 28 so that it will not come off in the user's inner ear canal. Referring back to FIGS. 1 and 21*a*-21*d*, the inner body 156 includes an aperture 162 running through the entire length of the inner body 156 and allows audio signals or sound to exit the nozzle 28 through the eartip 16.

As with the rear housing 12 and the base portion 30 of the front housing 14, the eartip 16 comes in three preferential sizes (e.g.—small, medium, and large). In one form, the flange 154 at the lower end 150 of the eartip 16 has a width along horizontal axis x of about 6.922 mm and a height along vertical axis y of about 8.288 mm. In this form, the flange 154 has a height to width ratio of about 1:1.1973 at its largest point. Again, the flange 154 tapers downwardly from the lower end 150 to the upper end 152 thus decreasing in size along the cross sectional length L of the eartip 16. In another form, the flange 154 at the lower end 150 of the eartip 16 has a width along horizontal axis x of about 9.870 mm and a height along vertical axis y of about 11.6178 mm. In this form, the flange 154 has a height to width ratio of about 1:1.178 at its largest point. In yet another form, the flange 154 at the lower end 150 of the eartip 16 has a width along horizontal axis x of about 13.430 mm and a height along vertical axis y of about 15.674 mm. In this form, the flange 154 has a height to width ratio of about 1:1.1671 at its largest point. Although a range of sizes is disclosed, the cross sectional shape along the length L of the eartip 16 will always be sized in a manner to make the eartip 16 oval in shape.

Figure 22:
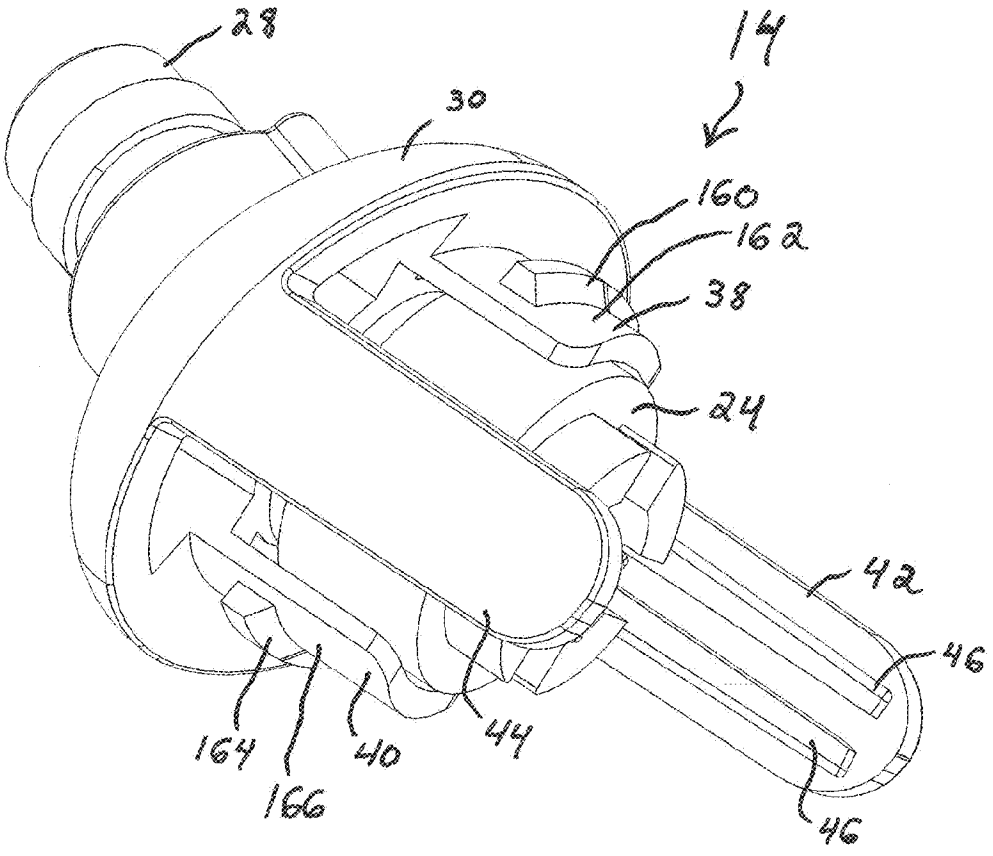
FIG. 22 illustrates a perspective view of a front housing of the headphone.
Figure 23A:
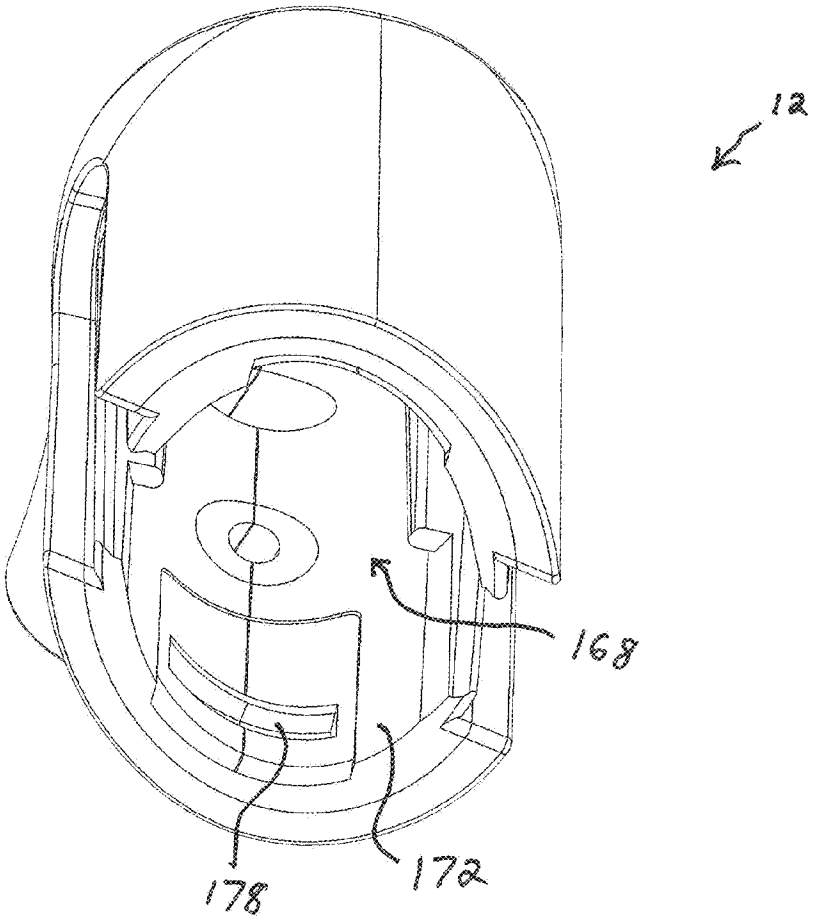
FIGS. 23*a-b* illustrate perspective views of a rear housing of the headphone.
Figure 23B:
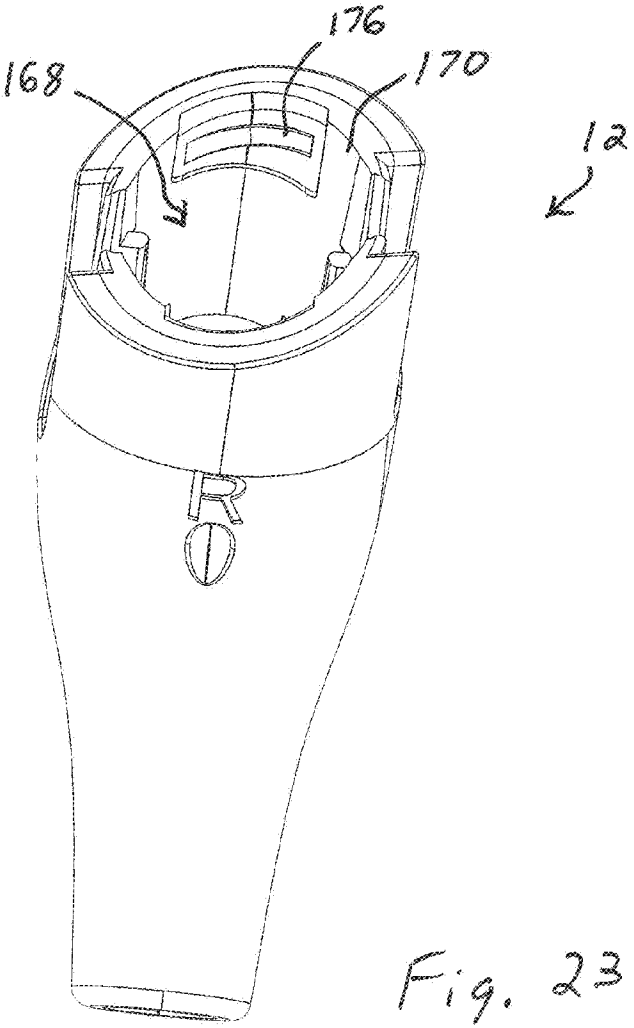

Referring to FIG. 22, the front housing 14 includes an upper driver support bracket 38 and a lower driver support bracket 40. The upper driver support bracket 38 includes a first tab 160 that protrudes upwardly from an upper surface 162 of the upper driver support bracket 38. The lower driver support bracket 40 includes a second tab 164 that protrudes downwardly from a lower surface 166 of the lower driver support bracket 40. Referring collectively to FIGS. 23*a* and 23*b*, the rear housing 12 includes an interior 168 that defines an upper surface 170 and a lower surface 172. A little inward from a front end 174 of the rear housing 12 is a first slot 176 in the upper surface 170 and a second slot 178 in the lower surface 172. When the rear housing 12 and the front housing 14 are assembled, the first tab 160 of the upper driver support bracket 38 becomes positioned in the first slot 176 in the upper surface 170 and the second tab 164 of the lower driver support bracket 40 becomes positioned in the second slot 178 in the lower surface 172 of the rear housing 12. Thus, the rear housing 12 and front housing 14 interlock with one another and are held together by the interconnection of the tabs 160, 164 and slots 176, 178.

Figure 24:
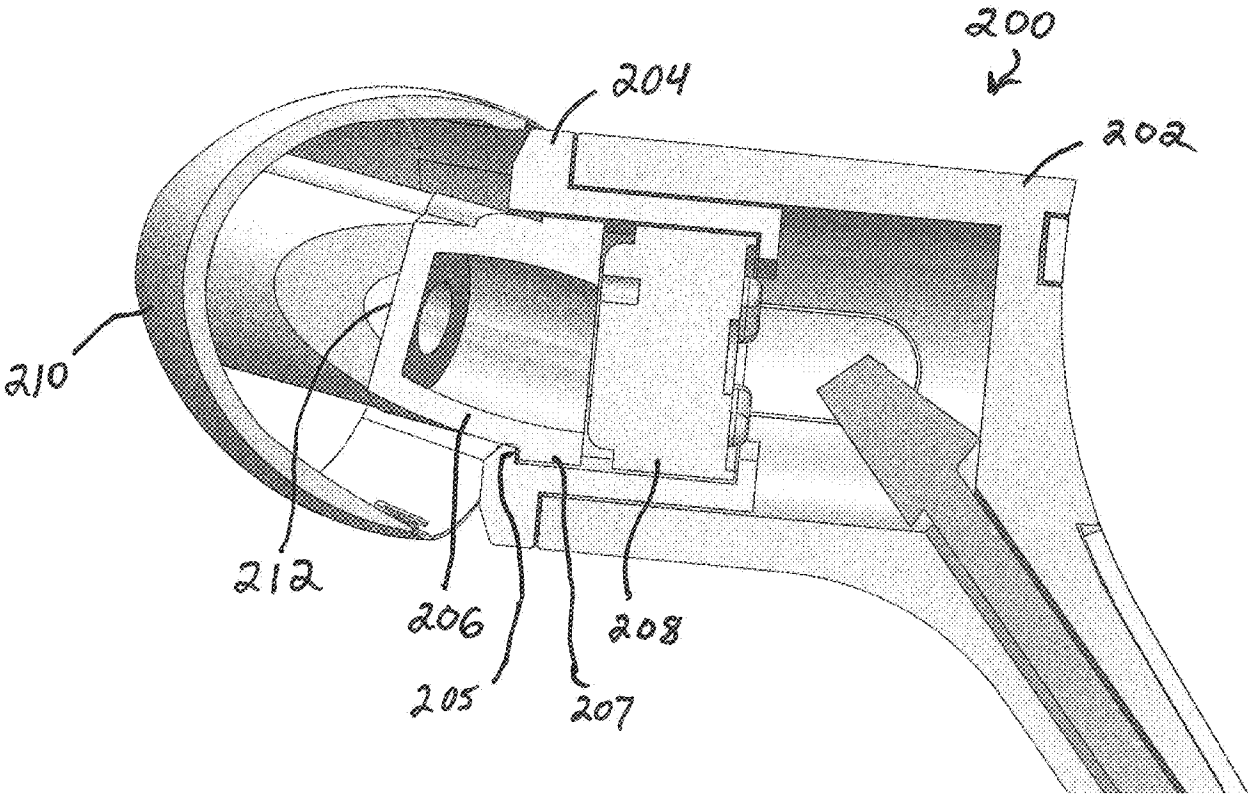
FIG. 24 illustrates a cross-sectional view of another representative headphone.

Referring to FIG. 24, a cross-sectional view of another representative headphone 200 as assembled is illustrated. In this form, the headphone 200 includes an oval shaped rear housing 202, an oval shaped front housing 204, and a nozzle 206. The oval shaped rear housing 202 is connected with the oval shaped front housing 204. As with the other forms, the rear and front housing 202, 204 have an oval shape sized as described above. Positioned within the front housing 204 is the nozzle 206. An upper end of the front housing 204 includes a cylindrical locking extension 205 that is used to secure a base portion 207 of the nozzle 206 within the front housing 204. A driver 208 is also positioned within a rear portion of the front housing 204. An eartip 210 as disclosed herein is connected with a front end 212 of the nozzle 206. All other features of the headphone 200 are similar to the features set forth with respect to the other embodiments disclosed herein and as such, a detailed discussion of these features is not necessary.

Figure 25:
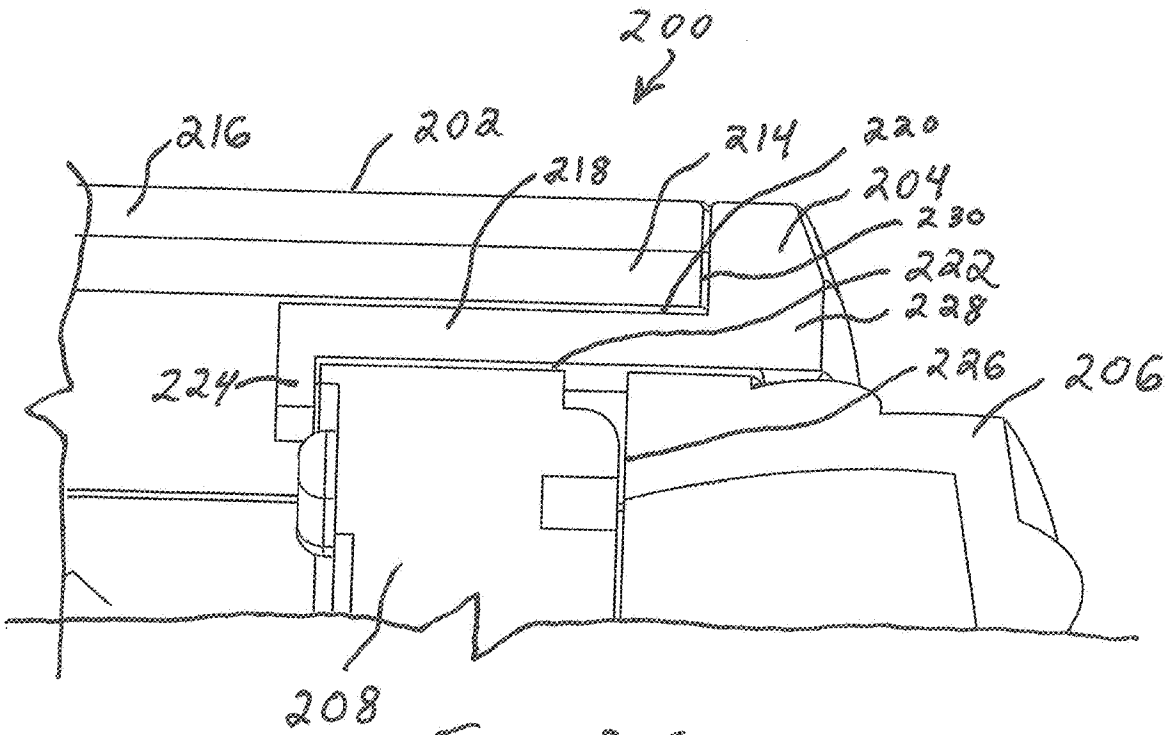
FIG. 25 illustrates a cross-sectional view of a portion of the headphone illustrated in FIG. 24.

Referring to FIG. 25, a cross-sectional side view of a representative headphone 200 is illustrated. In this form, the oval shaped rear housing 202 comprises two layers of material. An inner layer 214 is included that comprises a plastic material. An outer layer 216 is included that comprises a rubber like material that is molded over the inner layer 214. In one form, the inner layer 214 has a thickness of about 0.7 mm and the outer layer 216 has a thickness of about 0.7 mm thereby making the rear housing 202 having a thickness of about 1.4 mm. In yet another form, the outer layer 216 has a thickness of about 0.4 mm. An interior portion 218 of the front housing 204 also has a thickness of about 0.7 mm. A first gap 220 exists between the inner layer 214 of the rear housing 202 and the interior portion 218 of the front housing 204. In one form, the first gap 220 has a thickness of about 0.1 mm. A second gap 222 exists between the driver 208 and the interior portion 218 of the front housing 204. In one form, the second gap 22 has a thickness of about 0.1 mm. Although only the upper portion of the headphone 200 is illustrated, the lower portion of the headphone 200 has the same tolerances and sizes discussed herein and mirrors the upper portion.

The oval shaped front housing 204 includes a lower end that forms a driver mounting base 224 for the driver 208. As illustrated, a lower end of the driver 208 is positioned on the driver mounting base 224. The nozzle 206 is positioned within the front housing 204 such that a 0.1 mm gap 226 exists between an upper end of the driver 208 and a lower end of the nozzle 206. An upper end 228 of the front housing 204 is aligned with a front end 230 of the rear housing 202. Although not illustrated, the rear housing 202 and front housing 204 may be connected together using tabs and slots as previously discussed. In other forms, the front housing 204 may be friction fit into the rear housing 202. As illustrated, the upper end of the driver 208 is entirely encapsulated by the front housing 204 and nozzle 208. This is important because the driver 208 is sealed in thereby not allowing any leakage to occur.

The width to height ratios disclosed herein provide a more comfortable fit than traditional in-ear headphones and allow for smaller housings to be utilized. The inner ear canal of the human ear generally has an oval shape or configuration. Providing an oval shaped eartip 16 in varying sizes allows the eartip 16 to provide a better and more comfortable seal in the inner ear canal. The oval shape of the housings also provides a better feel and fit for users of the headphones disclosed herein.

While the use of words such as preferable, preferably, preferred or more preferred utilized in the description indicate that the feature so described may be more desirable, such feature(s) may not be necessary. Embodiments lacking the same are within the scope of the invention as defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An in-ear headphone, comprising:

an oval shaped housing defining an internal chamber, wherein a front portion of said oval shaped housing defines a cylindrical shaped nozzle extending away from said oval shaped housing having an internal audio channel;

a driver positioned in said internal chamber such that a sound reproduction portion of said driver is aligned with said internal audio channel running through said nozzle;

a damper positioned in an end of the nozzle having a damper aperture having a predetermined diameter; and wherein said cylindrical shaped nozzle extends from said front portion of said oval shaped housing at a predetermined upward angle in relation to a horizontal axis of said oval shaped housing and a predetermined bend angle in relation to a vertical axis of said oval shaped housing.

2. The in-ear headphone of claim 1, wherein said oval shaped housing comprises a front housing connected with a rear housing, wherein said front housing includes said front portion and said nozzle, wherein said front portion of said front housing and said rear housing are oval shaped.

3. The in-ear headphone of claim 1, wherein said oval shaped housing has across sectional width of about 9.575 mm and a cross sectional height of about 11.277 mm.

4. The in-ear headphone of claim 1, wherein said oval shaped housing has across sectional width to height ratio of about 1:1.177.

5. The in-ear headphone of claim 1, wherein said oval shaped housing has a cross sectional width in a range of about 6.715 mm to 13.029 mm and a cross sectional height in a range of about 8.045 mm to 15.214 mm, wherein said cross sectional width and said cross sectional height are selected such that said housing is always oval shaped.

6. The in-ear headphone of claim 1, wherein said oval shaped housing has across sectional width to height ratio in a range of about 1:1.168 to 1:1.198.

7. The in-ear headphone of claim 1, further comprising a vent located on a lower surface of said housing in communication with said internal chamber.

8. The in-ear headphone of claim 1, further comprising an oval shaped eartip connected with an end of said nozzle.

9. The in-ear headphone of claim 8, wherein said oval shaped eartip has a lower end that tapers downwardly toward a narrower upper end.

10. The in-ear headphone of claim 9, wherein said lower end of said oval shaped eartip has a width of about 9.870 mm and a height of about 11.618 mm.

11. The in-ear headphone of claim 9, wherein said lower end of said oval shaped eartip has a width to height ratio of about 1:1.178.

12. The in-ear headphone of claim 9, wherein said lower end of said oval shaped eartip has a width of about 6.922 mm and a height of about 8.288 mm.

13. The in-ear headphone of claim 9, wherein said lower end of said oval shaped eartip has a width to height ratio of about 1:1.1973.

14. The in-ear headphone of claim 9, wherein said lower end of said oval shaped eartip has a width of about 13.340 mm and a height of about 15.674 mm.

15. The in-ear headphone of claim 9, wherein said lower end of said oval shaped eartip has a width to height ratio of about 1:1.1671.

16. The in-ear headphone of claim 1, wherein said predetermined diameter of said damper aperture is about 0.6 millimeters.

17. The in-ear headphone of claim 1, wherein said predetermined upward angle is about 10.0°.

18. The in-ear headphone of claim 1, wherein said predetermined bend angle is about 22.0°.

19. The in-ear headphone of claim 1, wherein said predetermined diameter of said damper aperture is about 0.6 millimeters, said predetermined upward angle is about 10.0°, and said predetermined bend angle is about 22.0°.

20. The in-ear headphone of claim 10, further comprising a vent located on a lower surface of said housing in communication with said internal chamber, wherein said vent has a diameter of about 1 millimeter.

21. The in-ear headphone of claim 1, wherein said predetermined diameter of said damper aperture is within a range of about 0.4 millimeters to 0.8 millimeters.

22. The in-ear headphone of claim 1, wherein said predetermined upward angle is within a range of about 8-12°.

23. The in-ear headphone of claim 1, wherein said predetermined bend angle is within a range of about 15-30°.

24. An in-ear headphone, comprising:

an oval shaped rear housing defining an internal chamber;

a front housing connected with said oval shaped rear housing, wherein said front housing includes an oval shaped base portion, wherein a nozzle extends outwardly and away from said base portion, wherein said nozzle includes an internal audio channel, wherein said nozzle has a predetermined upward angle in relation to a horizontal axis of said oval shaped rear housing and a predetermined bend angle in relation to a vertical axis of said oval shaped rear housing;

a driver connected with a rear portion of said oval shaped base portion of said front housing such that a sound reproduction portion of said driver is aligned with said internal audio channel of said nozzle, wherein a portion of said driver is positioned in said internal chamber and said rear portion of said front housing;

a damper positioned in an end of said nozzle having a damper aperture having a predetermined diameter; and an oval shaped eartip connected with an end of said nozzle.

25. The in-ear headphone of claim 24, wherein said oval shaped rear housing and said oval shaped base portion of said front housing has a cross sectional width of about 9.575 mm and a cross sectional height of about 11.277 mm.

26. The in-ear headphone of claim 24, wherein said oval shaped rear housing and said oval shaped base portion of said front housing has a cross sectional width in a range of about 6.715 mm to 13.029 mm and a cross sectional height in a range of about 8.045 mm to 15.214 mm, wherein said cross sectional width and said cross sectional height are selected such that said oval shaped rear housing and said base portion are always oval shaped.

27. The in-ear headphone of claim 24, wherein said oval shaped rear housing and said base portion of said front housing has a cross sectional width to height ratio in a range of about 1:1.168 to 1:1.198.

28. The in-ear headphone of claim 24, further comprising a gasket positioned between said rear portion of said base portion and said sound reproduction portion of said driver.

29. The in-ear headphone of claim 24, wherein said predetermined upward angle is about 10.0°.

30. The in-ear headphone of claim 24, wherein said predetermined bend angle is about 22.0°.

31. The in-ear headphone of claim 24, wherein said predetermined diameter of said damper aperture is about 0.6 millimeters.

32. An in-ear headphone, comprising:

an oval shaped rear housing defining an internal chamber, wherein said oval shaped rear housing comprises an outer housing secured over an inner housing;

an oval shaped front housing having a base portion and a driver mounting base;

a driver positioned in said driver mounting base of said oval shaped front housing;

a nozzle positioned in an upper portion of said oval shaped front housing including a portion that extends forward and away from said base portion of said oval shaped front housing that includes an internal audio channel running therethrough, wherein an inlet to said internal audio channel is aligned with a sound reproduction portion of said driver, wherein said nozzle extends forward and away from said base portion at a predetermined upward angle in relation to a horizontal axis of said base portion and a predetermined bend angle in relation to a vertical axis of said base portion; and a damper positioned in an end of said nozzle, wherein said damper includes a damper aperture having a predetermined diameter.

33. The in-ear headphone of claim 32, wherein said outer housing of said oval shaped rear housing comprises a rubber-like material.

34. The in-ear headphone of claim 32, further comprising an oval shaped eartip connected with an end of said nozzle.

35. The in-ear headphone of claim 32, wherein said predetermined upward angle is about 10.0°.

36. The in-ear headphone of claim 32, wherein said predetermined bend angle is about 22.0°.

37. The in-ear headphone of claim 32, wherein said predetermined diameter of said damper aperture is about 0.6 millimeters.

38. The in-ear headphone of claim 32 wherein said oval shaped rear housing and said oval shaped front housing has a cross sectional width of about 9.575 mm and a cross sectional height of about 11.277 mm.

39. The in-ear headphone of claim 32, wherein said oval shaped rear housing and said oval shaped front housing has a cross sectional width in a range of about 6.715 mm to 13.029 mm and a cross sectional height in a range of about 8.045 mm to 15.214 mm, wherein said cross sectional width and said cross sectional height are selected such that said oval shaped rear housing and said base portion are always oval shaped.

40. The in-ear headphone of claim 32, wherein said oval shaped rear housing and said oval shaped front housing has a cross sectional width to height ratio in a range of about 1:1.168 to 1:1.198.

* * * * *